US012157550B2

(12) United States Patent
Kim et al.

(10) Patent No.: US 12,157,550 B2
(45) Date of Patent: Dec. 3, 2024

(54) VARIABLE-PITCH PROPELLER HAVING OPTIMAL HUB-TO-TIP DIAMETER RATIO

(71) Applicants: Korea Shipbuilding & Offshore Engineering Co., Ltd., Seoul (KR); Hyundai Heavy Industries Co., Ltd., Ulsan (KR)

(72) Inventors: Jae Boo Kim, Seoul (KR); Chan Kyu Choi, Seoul (KR); Sung Hoon Kim, Seoul (KR); Kil Hwan Moon, Seoul (KR); Do Wan Kim, Seoul (KR); Gwan Hee Son, Seoul (KR)

(73) Assignees: Korea Shipbuilding & Offshore Engineering Co., Ltd., Seoul (KR); Hyundai Heavy Industries Co., Ltd., Ulsan (KR)

( * ) Notice: Subject to any disclaimer, the term of this patent is extended or adjusted under 35 U.S.C. 154(b) by 0 days.

(21) Appl. No.: 17/926,504

(22) PCT Filed: May 17, 2021

(86) PCT No.: PCT/KR2021/006123
§ 371 (c)(1),
(2) Date: Nov. 18, 2022

(87) PCT Pub. No.: WO2021/235790
PCT Pub. Date: Nov. 25, 2021

(65) Prior Publication Data

US 2023/0278685 A1 Sep. 7, 2023

(30) Foreign Application Priority Data

May 21, 2020 (KR) ..... 10-2020-0061136
Jul. 31, 2020 (KR) ..... 10-2020-0096303

(51) Int. Cl.
*B63H 3/00* (2006.01)
*B63H 1/16* (2006.01)
(Continued)

(52) U.S. Cl.
CPC ..... *B63H 3/008* (2013.01); *B63H 1/16* (2013.01); *B63H 2001/165* (2013.01); *B63H 1/20* (2013.01); *B63H 3/06* (2013.01)

(58) Field of Classification Search
CPC . B63H 1/16; B63H 1/165; B63H 1/20; B63H 2001/283; B63H 3/00; B63H 3/006;
(Continued)

(56) References Cited

U.S. PATENT DOCUMENTS 4,304,524 A * 12/1981 Coxon ..... B63H 3/008 416/131
5,240,374 A * 8/1993 Speer ..... B63H 3/008 416/89
(Continued)

FOREIGN PATENT DOCUMENTS

JP S53 151098 U 11/1978
JP 2017-190020 A 10/2017
(Continued)

OTHER PUBLICATIONS

Ki-In Kim, "A Study on the Structural Design of a Marine Controllable Pitch Propeller System." Doctoral Dissertation for Doctor of Engineering, Department of Marine System Engineering Graduate School of Korea Maritime University, 2007.

*Primary Examiner* — Binh Q Tran
(74) *Attorney, Agent, or Firm* — Blank Rome LLP

(57) ABSTRACT

The present invention relates to a controllable pitch propeller capable of changing a blade pitch according to the sailing conditions of a ship and, specifically, to a controllable pitch propeller having an optimal hub-to-tip diameter ratio, the
(Continued)

propeller being capable of reducing the size of a hub so as to have a high efficiency that is close to the propulsion efficiency of a fixed pitch propeller (FPP). In order to accomplish the aforementioned objective, the present invention relates a controllable pitch propeller which comprises a hub mounted at the propelling shaft of a ship, and a blade that is mounted at the circumference of the hub and that has a variable pitch, and which is technically characterized by a H/D ratio, of diameter (H) of the propeller and diameter (D) of the hub, of 0.170-0.2.

18 Claims, 37 Drawing Sheets

(51) Int. Cl.
*B63H 1/20* (2006.01)
*B63H 3/06* (2006.01)

(58) Field of Classification Search
CPC . B63H 3/008; B63H 3/02; B63H 3/04; B63H 3/081; B63H 2003/088; B63H 3/10; B63H 3/12; B63H 5/07; B63H 2001/165; B63H 3/06; B63H 11/04; B63H 11/06; B63H 17/0018; Y02T 70/50
See application file for complete search history.

(56) References Cited

U.S. PATENT DOCUMENTS

| | | | | |
|---|---|---|---|---|
| 5,352,093 | A * | 10/1994 | Hannon | B63H 1/20 416/234 |
| 5,405,243 | A | 4/1995 | Hurley et al. | |
| 7,637,722 | B1 * | 12/2009 | Koepsel | B63H 1/14 416/241 R |
| 10,597,129 | B1 * | 3/2020 | Broinowski | F01N 13/004 |
| 2006/0154536 | A1 * | 7/2006 | Rosenkranz | B63H 20/14 440/83 |
| 2007/0249242 | A1 * | 10/2007 | Gongwer | B63H 20/00 440/38 |
| 2009/0305584 | A1 * | 12/2009 | Acampora | B63H 5/08 440/67 |
| 2018/0073367 | A1 * | 3/2018 | Murdoch | F03B 13/264 |
| 2019/0061891 | A1 * | 2/2019 | Kaufman | B63H 21/17 |
| 2020/0408184 | A1 * | 12/2020 | Schneider | F03B 3/121 |

FOREIGN PATENT DOCUMENTS

| | | | |
|---|---|---|---|
| JP | 2020-15347 | A | 1/2020 |
| KR | 10-2001-0040686 | A | 5/2001 |
| KR | 10-2008-0099253 | A | 11/2008 |
| KR | 10-2011-0063670 | A | 6/2011 |
| KR | 10-2012-0116098 | A | 10/2012 |
| KR | 10-1501903 | B1 | 3/2015 |
| KR | 10-2016-0116224 | A | 10/2016 |
| WO | WO 99/39973 | A1 | 8/1999 |
| WO | WO 2007/077205 | A1 | 7/2007 |
| WO | WO 2010/031736 | A1 | 3/2010 |

* cited by examiner

VARIABLE-PITCH PROPELLER HAVING OPTIMAL HUB-TO-TIP DIAMETER RATIO

TECHNICAL FIELD

The present disclosure relates to a variable-pitch propeller capable of changing the blade pitch according to the operating conditions of a ship, and more particularly, to a variable-pitch propeller with an optimum hub diameter ratio in which the size of the hub may be reduced to have high efficiency close to the propulsion efficiency of a fixed pitch propeller (FPP).

BACKGROUND ART

A propeller is a device that propels a ship by changing the power of the propulsion engine transmitted through the shaft into thrust. Ship propellers include a screw propeller, a jet propeller, a paddle wheel, and a Voith Schneider propeller, and the like. Among them, a screw propeller is the most widely used because of its high propulsion efficiency, simple structure, and low manufacturing cost compared to other types of propulsion devices.

A screw propeller may also be classified by performance, such as a fixed pitch propeller (FPP) in which the propeller blades are fixed to a hub connected to the rotating shaft, a controllable pitch propeller (CPP) in which the propeller blades are movable in a hub connected to the rotating shaft, thereby adjusting the pitch angle, a contra-rotating propeller (CRP) that recovers the rotational force from a front propeller by using a rear propeller rotating in the opposite direction to the front propeller and converts it into propulsion, and the like.

In low-speed ships such as large commercial ships and oil tankers, propeller efficiency and fuel efficiency are important factors. Therefore, in general, a fixed pitch propeller capable of operating at a constant ship speed is mounted on the low-speed ship.

Recently, as various marine environmental regulations have been strengthened to solve problems such as environmental pollution, there is a problem that a ship cannot satisfy various marine environmental regulations in operating the ship with a fixed pitch propeller designed for the purpose of increasing fuel efficiency.

Meanwhile, in the case of a conventional controllable pitch propeller that may vary the pitch of the blades according to the operating conditions of the ship, facilities and equipment for changing the angle of the blades should be installed in the hub. Accordingly, there is a disadvantage in that the size of the hub becomes larger than the size of the hub of the fixed pitch propeller. In addition, the airfoil is not optimized for a specific pitch as it should be operated at various pitches. Therefore, the conventional controllable pitch propeller has a problem that the propulsion efficiency of it is 4 to 8% lower than that of the fixed pitch propeller. Also, due to the increase in manufacturing cost caused by the complicated processing of the controllable pitch propeller, it is less effective to apply the controllable pitch propeller to low-speed ships.

Meanwhile, it is necessary to change the operating conditions for a low-speed ship to cope with various marine environmental regulations and operate properly. In addition, although the pitch of the blades should be efficiently changed according to the change of the operating conditions, there is a problem in that it is not easy to apply due to disadvantages such as an increase in unit cost and a decrease in propulsion efficiency.

Hereinafter, the drive mechanism of a conventional controllable pitch propeller will be described in detail.

FIG. 1 is a conceptual view illustrating the drive mechanism of a controllable pitch propeller according to the prior art. FIG. 2 is an exploded view of the controllable pitch propeller illustrated in FIG. 1. FIGS. 3A to 3C are conceptual views illustrating a relationship in which the pitch of the blades is changed by hydraulic pressure.

As shown in FIG. 1, the controllable pitch propeller 10 has a plurality of blades 20 mounted at an equal angle around the hub 30, and the cross head 31 moves in the longitudinal direction of the hub 30 according to the flow the hydraulic oil supplied through the hydraulic line extending into the hub 30.

The crosshead 31 has a column structure having as many side surfaces as the number of blades 20. As an example, when the number of blades 20 mounted on the hub 30 is four, the crosshead 31 having a quadrangular prism structure is provided. Also, when the number of blades 20 is five, the crosshead may have a pentagonal prism structure.

Meanwhile, a blade carrier 23 is fixed to a blade shank 21. In a state where a pin 25 formed in the blade carrier 23 is matched with the crosshead 31, the crosshead 31 moves forward and backward in the longitudinal direction of the hub 30 by hydraulic pressure. Accordingly, the blade pitch is changed by the matching structure of the crosshead 31 and the pin 25.

As shown in FIG. 2, a slide groove 33 is formed on the side surface of the crosshead 31 in a direction perpendicular to the center line of the propulsion shaft 1, which is the longitudinal direction of the hub 30.

A sliding shoe 35 is positioned in the slide groove 33, and the pin 25 is inserted into the sliding shoe 35.

In the case of the controllable pitch propeller 10 according to the prior art, the crosshead 31 moves forward and backward along the longitudinal direction of the hub 30, that is, the center line of the propulsion shaft 1 by hydraulic pressure. In this case, as shown in FIGS. 3A to 3C, the sliding shoe 35 moves in a vertical direction with respect to the center line of the propulsion shaft 1 which is the longitudinal direction of the slide groove 33. At the same time, as the crosshead 31 moves along the center line of the propulsion shaft 1, the pin 25 rotates with the center point of the blade carrier 23 as the origin point.

That is, as the pin 25 moves in the vertical direction of the slide groove 33 along with the forward and backward movement of the crosshead 31, the blade 20 rotatably mounted around the hub 30 is rotated to adjust the blade pitch.

As described above, in the case of the drive mechanism of the conventional controllable pitch propeller 10, the pin 25 adjusts the blade pitch while moving along the slide groove 33 formed perpendicular to the center line of the propulsion shaft 1 together with the crosshead 31 moving forward and backward along the center line of the propulsion shaft 1. In this case, in order to sufficiently secure an adjustable range of the blade pitch, the length of the slide groove 33 in the vertical direction should be sufficiently secured. Accordingly, the crosshead 31 should be enlarged, and as the crosshead 31 is enlarged, there is a problem that the hub 30 of the propeller is also enlarged.

In addition, as the slide groove 33 is formed in the rotational direction of the controllable pitch propeller 10, the direction of resistance generated by the rotation of the propeller 10 and the longitudinal direction of the slide groove 33 are almost the same.

Therefore, in order to maintain the blade pitch, the crosshead 31 should be fixed by hydraulic pressure so as not to move in the direction of the propulsion shaft. In order to fix the movement of the crosshead 31 by hydraulic pressure as described above, the required performance (flow rate and pressure) of the hydraulic system should be high, thereby causing a problem that the cost of the hydraulic system increases.

Meanwhile, the pin 25 of the conventional controllable pitch propeller 10 may be rotated by about 70 degrees. Therefore, the variable range of the blade pitch is also about ±35 degrees, so there is an advantage in that the adjustment range of the pitch angle is wide. However, there is a disadvantage in that a controllable pitch propeller having a larger hub than necessary is mounted as it has a wider variable range than necessary depending on the type of ship.

As described above, in the conventional controllable pitch propeller, the hub is formed larger than the diameter of the propeller as the size of the crosshead increases according to the structure of the slide groove and the capacity of the hydraulic system increases.

As an example, the left propeller illustrated in FIG. 10 shows a structure of a conventional controllable pitch propeller, and has an H/D value of 0.206. Here, H is the diameter of the hub, and D is the diameter of the propeller.

RELATED PATENTS

Japanese Patent Publication No. 2020-0015347 (Publication Date: Jan. 30, 2020)

Japanese Patent Publication No. 2017-190020 (Publication Date: Oct. 19, 2017)

Korean Patent Publication No. 10-2016-0116224 (Publication Date: Oct. 7, 2016)

DISCLOSURE

Technical Problem

The present disclosure is designed to solve the problems of the prior art as described above, and therefore the present disclosure is directed to providing a controllable pitch propeller capable of changing the blade pitch according to operating conditions by configuring the blades of the propeller to be variable in the two pitch range. The present disclosure is also directed to providing a controllable pitch propeller having an optimum hub diameter ratio capable of minimizing an increase in hub size and exhibiting high efficiency close to the propulsion efficiency of a fixed pitch propeller.

Technical Solution

The present disclosure for achieving the above object relates to a controllable pitch propeller including a hub mounted on the propulsion shaft of a ship, and a blade mounted around the hub and having a variable pitch, wherein the H/D ratio of the hub diameter H to the propeller diameter D is 0.170 to 0.2.

In addition, according to a preferred embodiment of the present disclosure, in the case of a Tanker that is a low-speed ship, the H/D ratio is 0.170 to 0.190.

Also, according to a preferred embodiment of the present disclosure, in the case of a Bulk Carrier that is a low-speed ship, the H/D ratio is 0.185 to 0.20.

Advantageous Effects

As described above, the controllable pitch propeller having an optimum hub diameter ratio according to the present disclosure is configured to be able to vary with a blade pitch suitable for operating conditions when operating conditions need to be changed due to various marine environmental regulations, and as the pin moves along the guide slot formed in a diagonal direction with respect to the longitudinal direction of the propulsion shaft, it is possible to reduce the hydraulic pressure required to change the blade pitch. As the blade pitch may be changed even with such a small hydraulic pressure in this way, the capacity of the hydraulic system is reduced, and accordingly, the size of the hub may be reduced.

In addition, as the guide slot is formed in a diagonal direction of the propulsion shaft, the size of the crosshead may be reduced, and thus the size of the hub may be configured to be smaller than that of the hub of the conventional controllable pitch propeller.

In this way, there is an advantage in that the size of the hub H/D may be reduced by 5 to 15% compared to the size of the hub of the conventional controllable pitch propeller by changing the drive mechanism of the controllable pitch propeller, and an advantage of having a structure that may reduce up to about 25% when the material of the propeller is changed and replaced.

DETAILED DESCRIPTION OF THE PREFERRED EMBODIMENTS

Hereinafter, a preferred embodiment of the controllable pitch propeller of the present disclosure will be described in detail with reference to the accompanying drawings in order of the drive mechanism of the controllable pitch propeller, the diameter ratio of the hub and the blade, the locking device at each dead center, and the hydraulic system.

Drive Mechanism of Controllable Pitch Propeller

Figure 1:
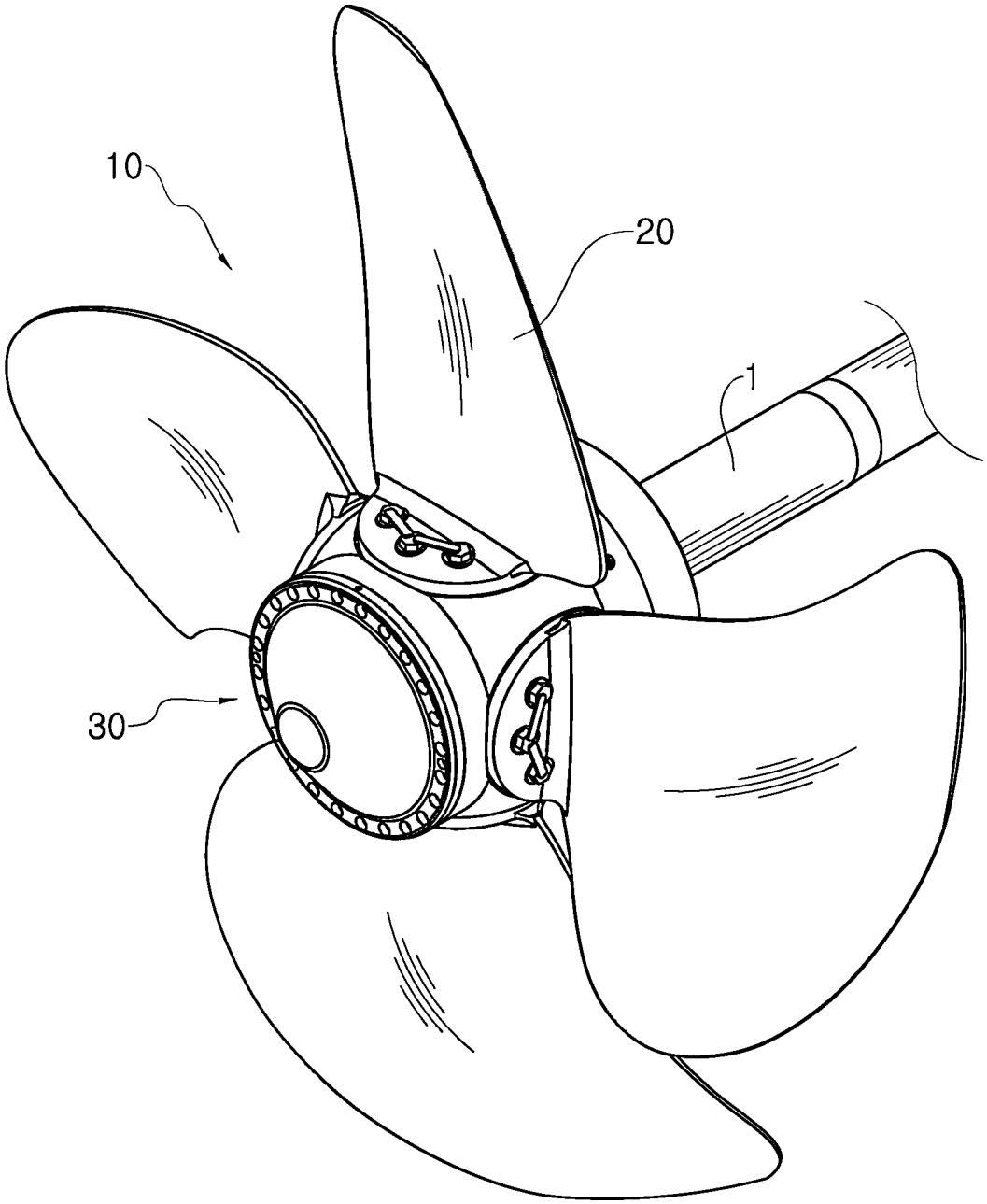
FIG. 1 is a conceptual view illustrating the drive mechanism of a controllable pitch propeller according to the prior art.
Figure 2:
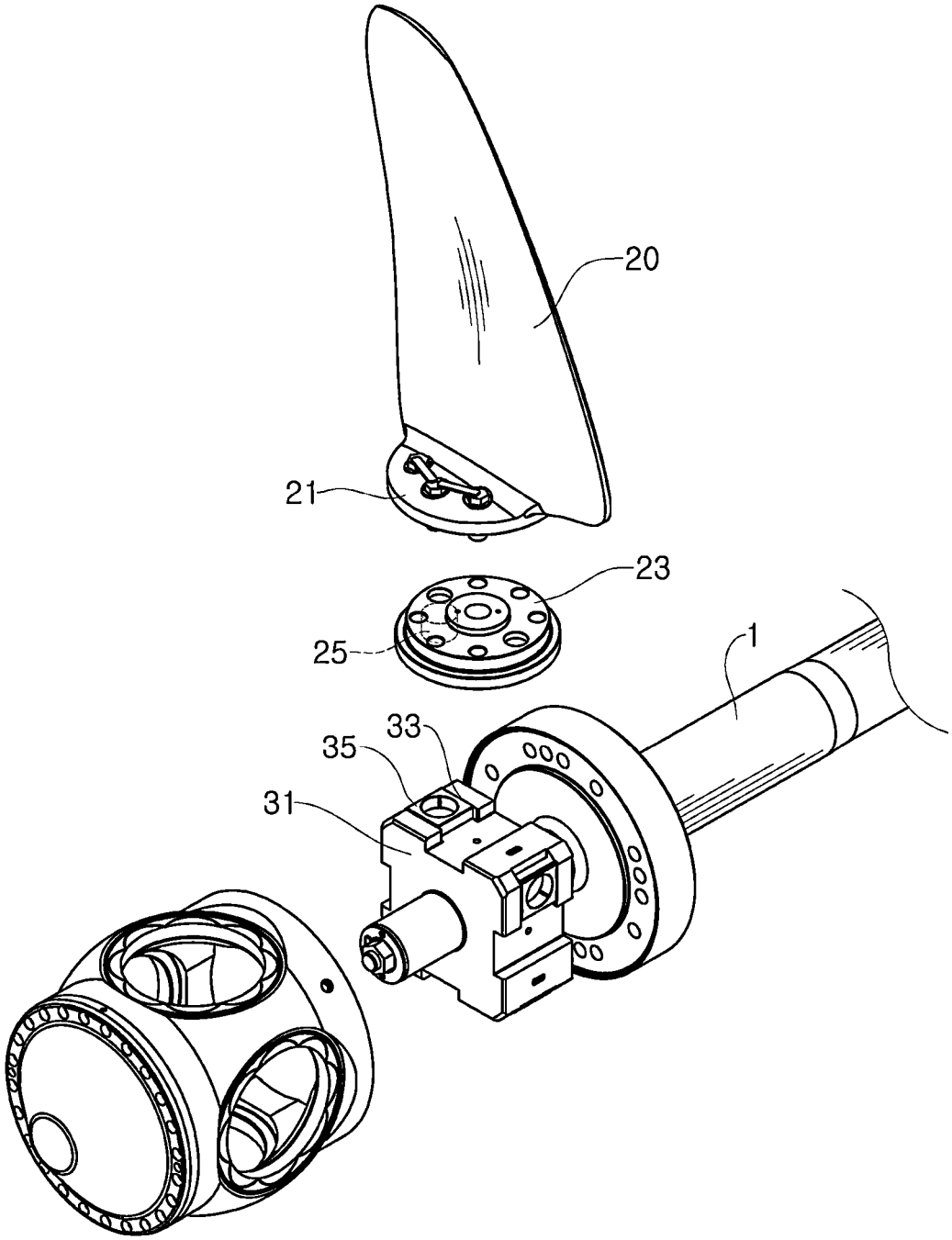
FIG. 2 is an exploded view of the controllable pitch propeller illustrated in FIG. 1.
Figure 3A:
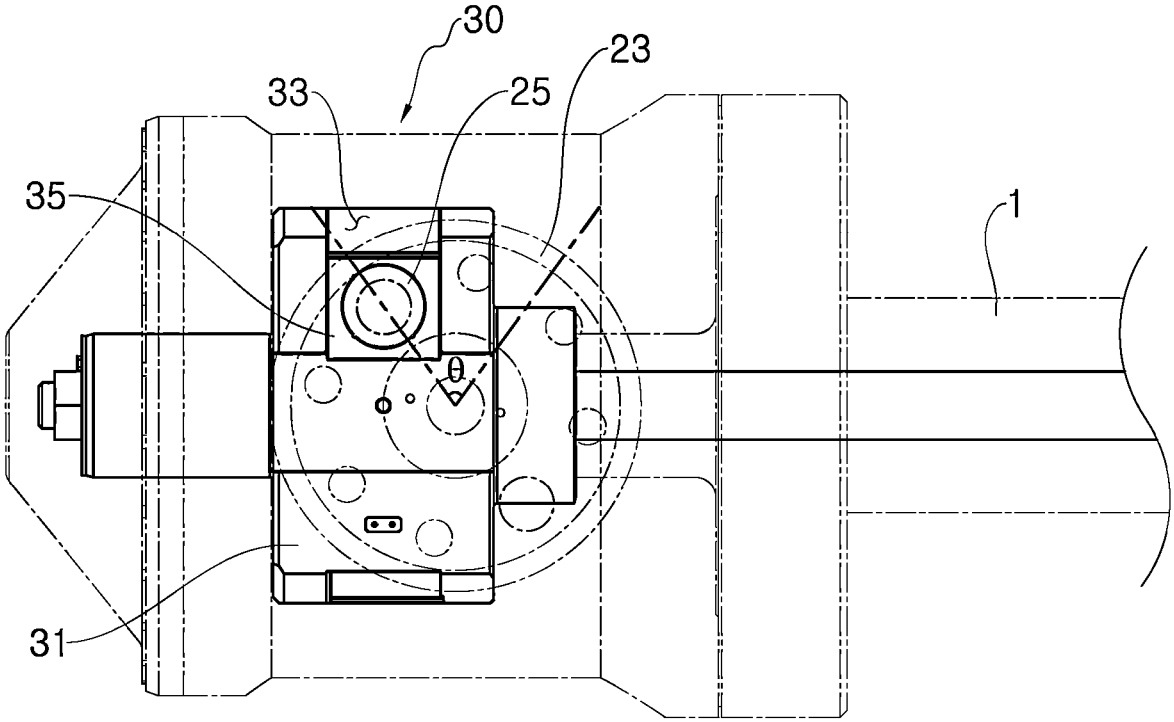
FIGS. 3A to 3C are conceptual views illustrating a relationship in which the pitch of the blades is changed by hydraulic pressure.
Figure 3B:
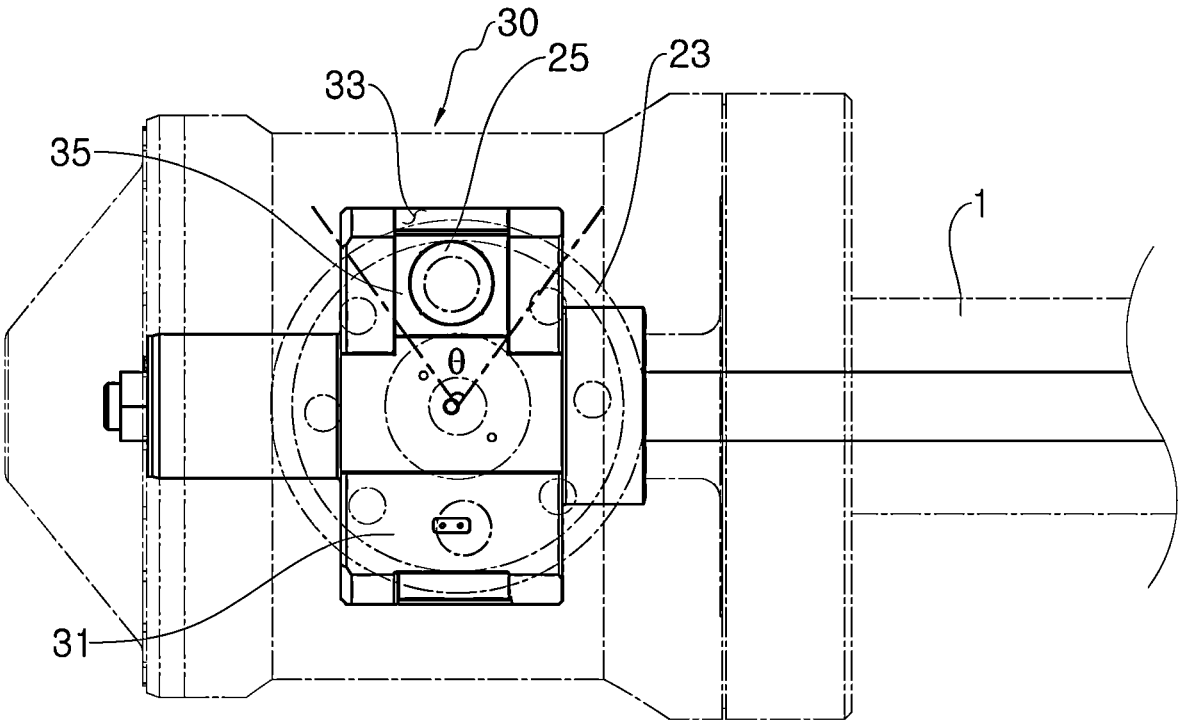
Figure 3C:
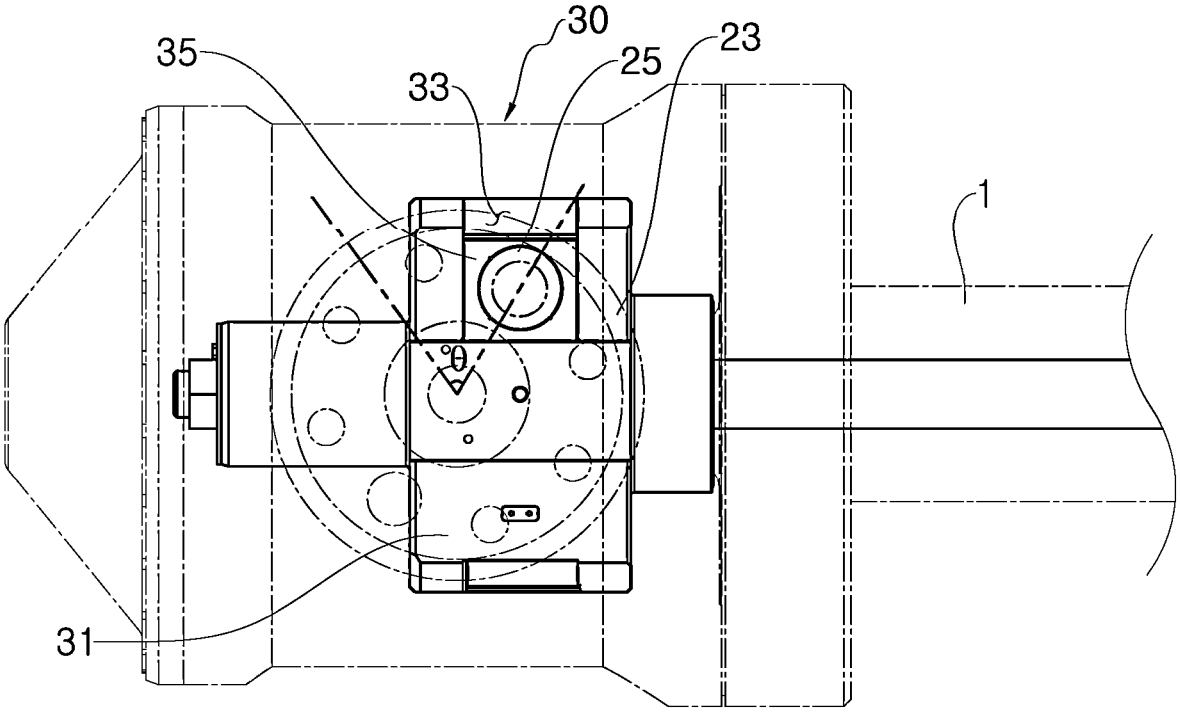
Figure 4:
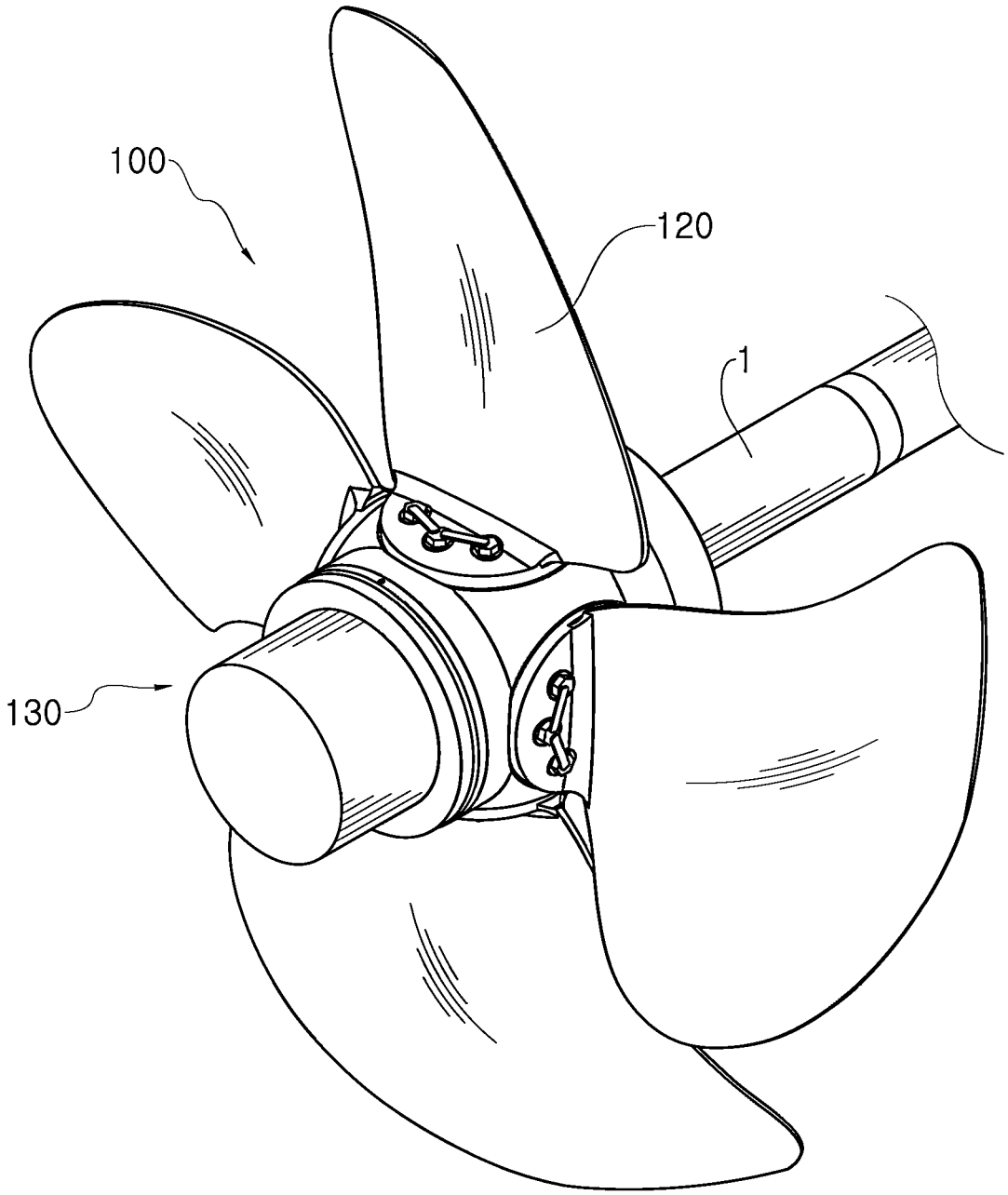
FIG. 4 is a perspective view illustrating a controllable pitch propeller according to an embodiment of the present disclosure.
Figure 5:
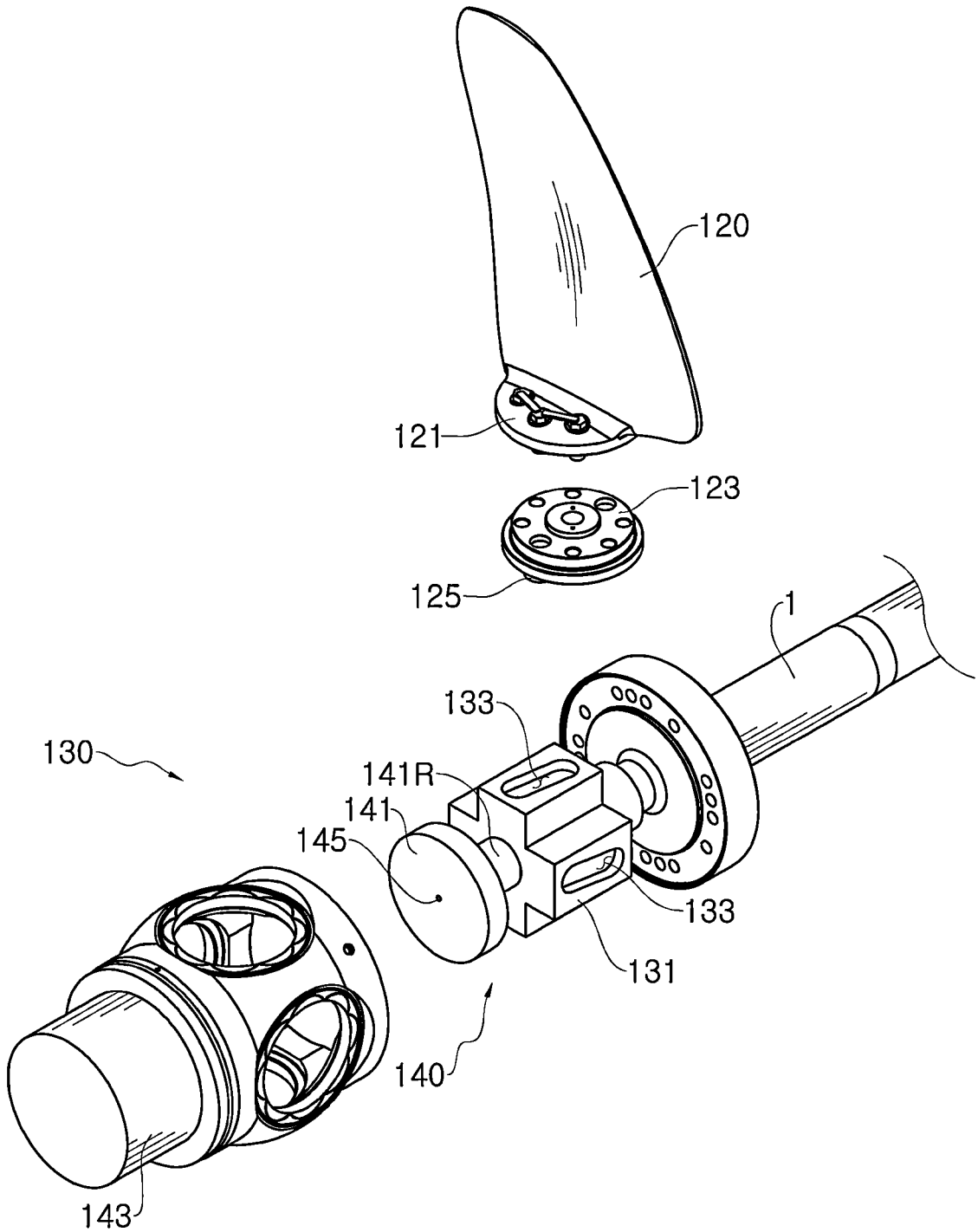
FIG. 5 is an exploded perspective view of the controllable pitch propeller illustrated in FIG. 4.
Figure 6A:
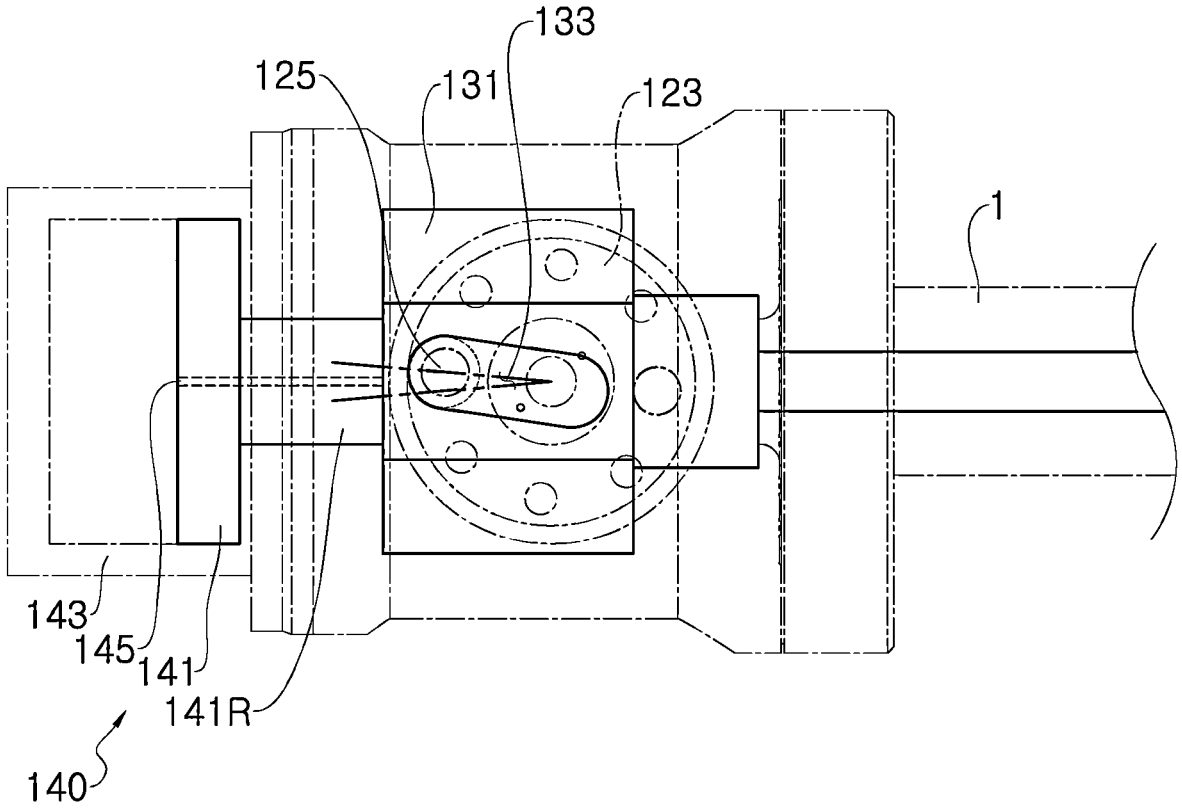
FIGS. 6A to 6C are conceptual views illustrating a relationship in which the pitch of the blades is changed by hydraulic pressure.
Figure 6B:
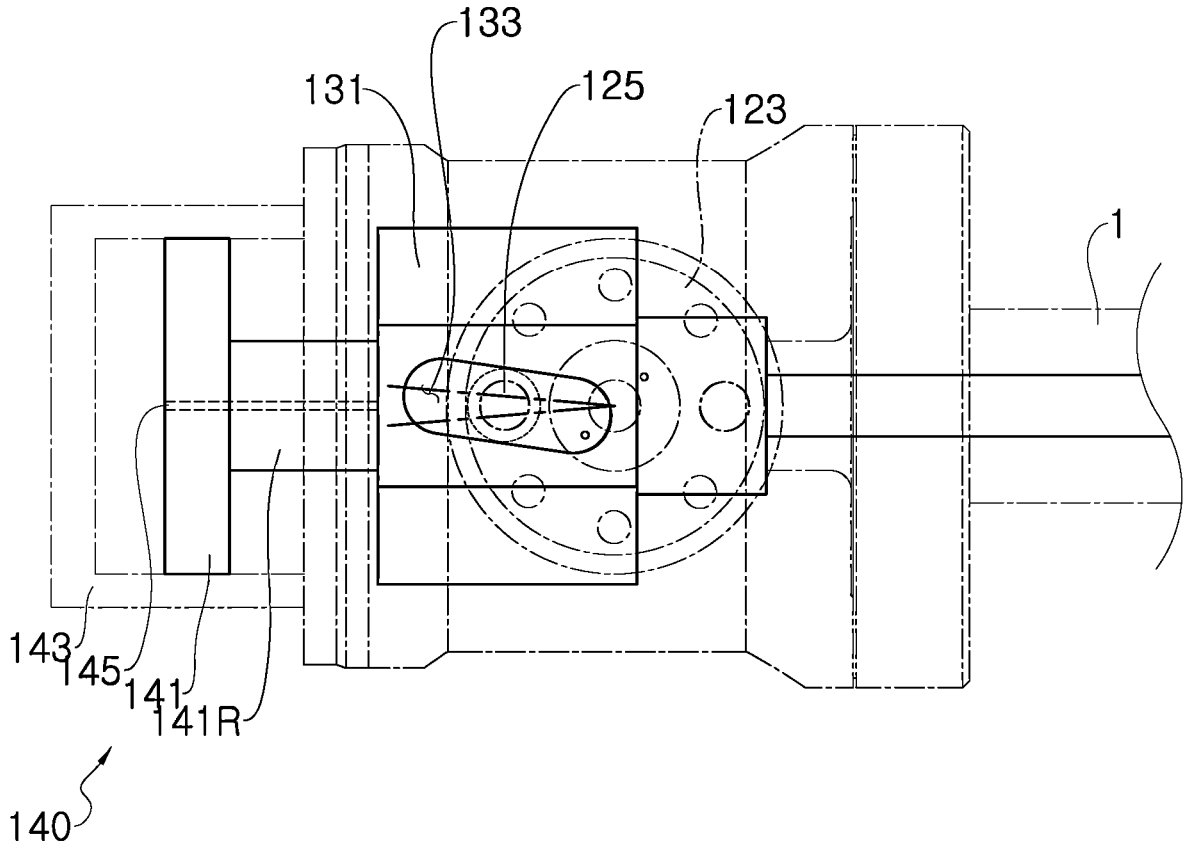
Figure 6C:
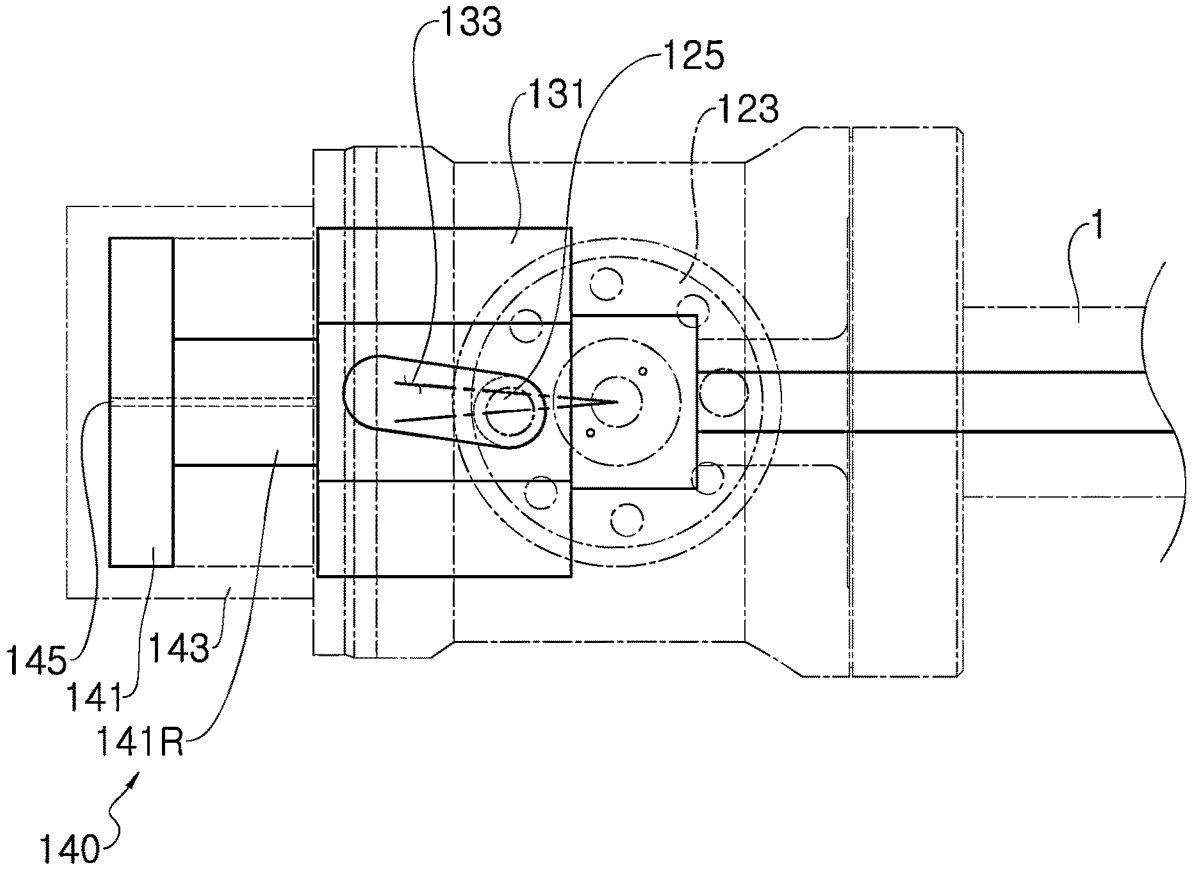
Figure 7:
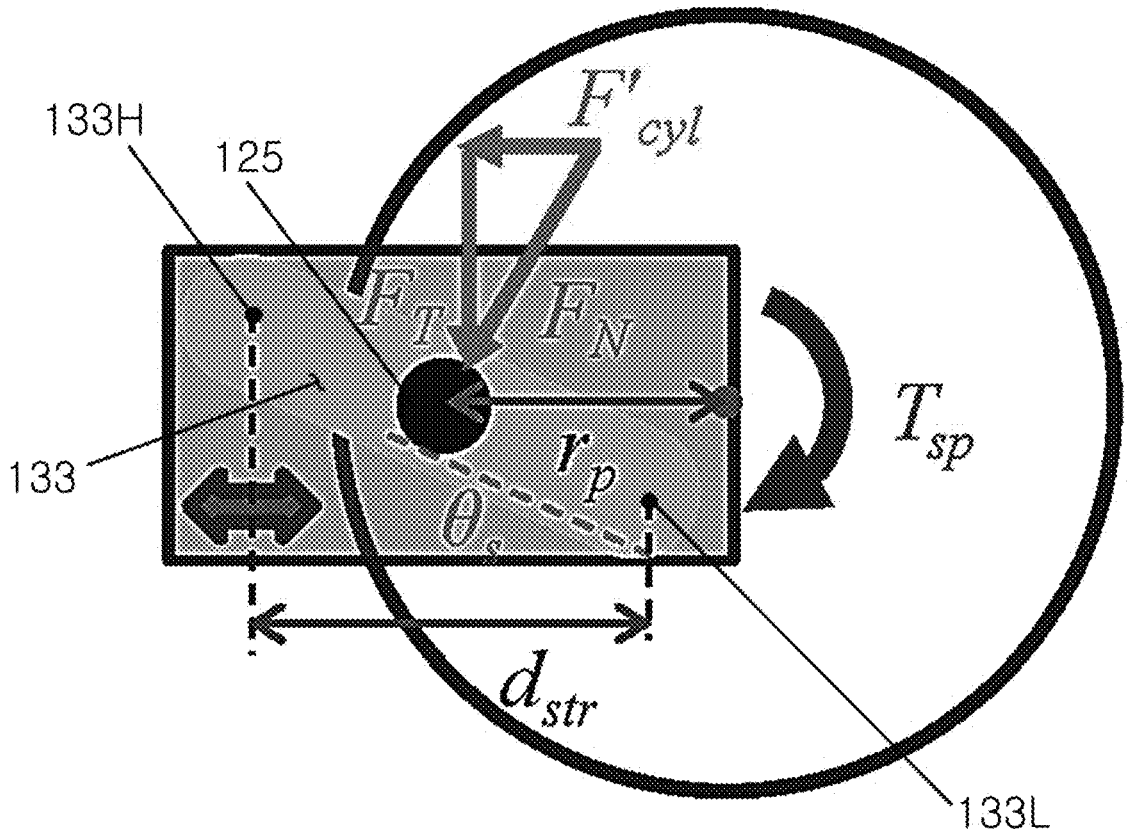
FIG. 7 is a conceptual view illustrating a force acting on a pin moving along a diagonal guide slot.
Figure 8A:
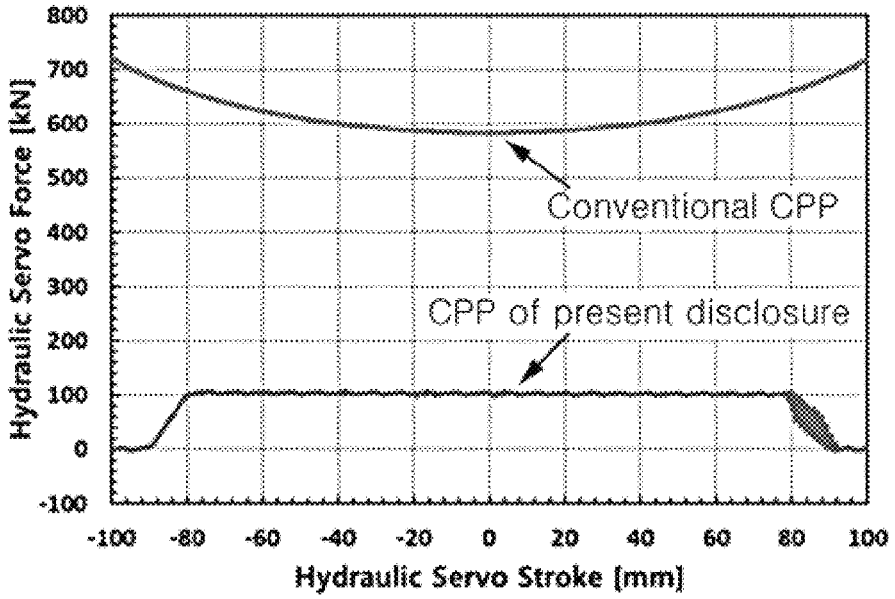
FIGS. 8A and 8B are graphs illustrating a change in pitch and a magnitude of hydraulic pressure according to movement of a crosshead.
Figure 8B:
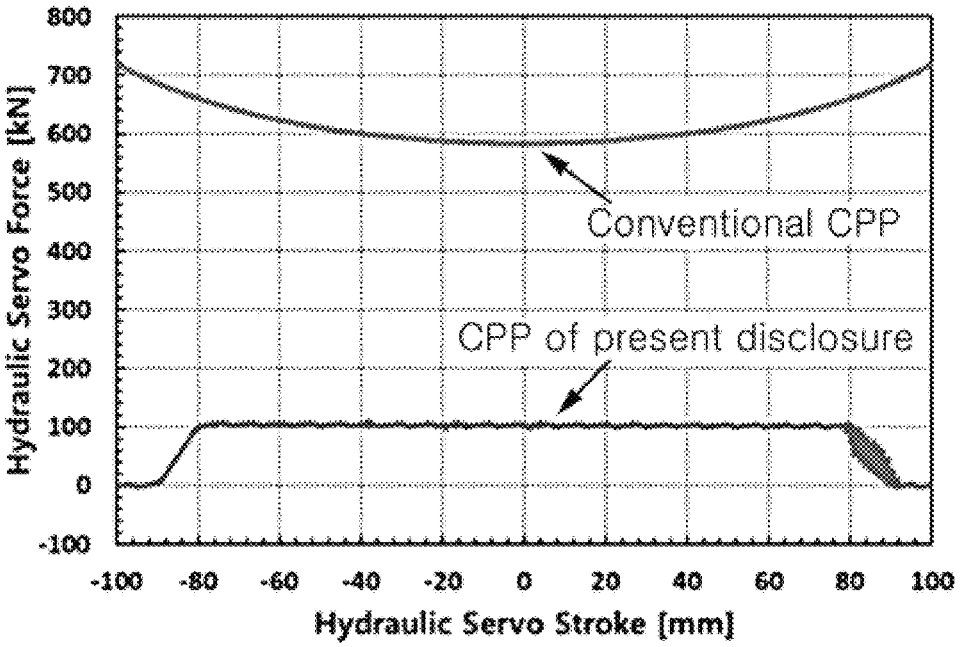
Figure 9A:
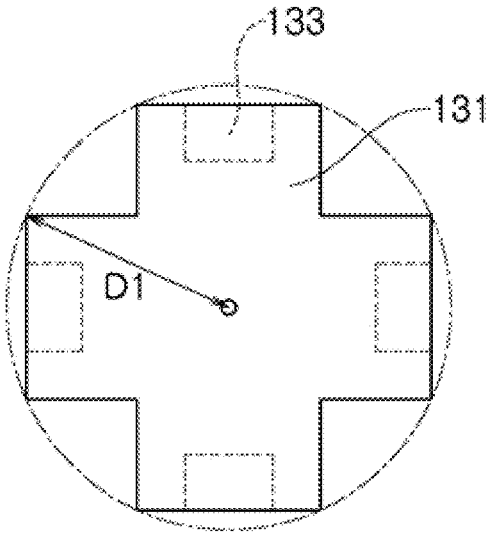
FIGS. 9A and 9B are conceptual views comparing the side surface of the crosshead of the controllable pitch propeller according to an embodiment of the present disclosure with the side surface of the crosshead of the conventional controllable pitch propeller.
Figure 9B:
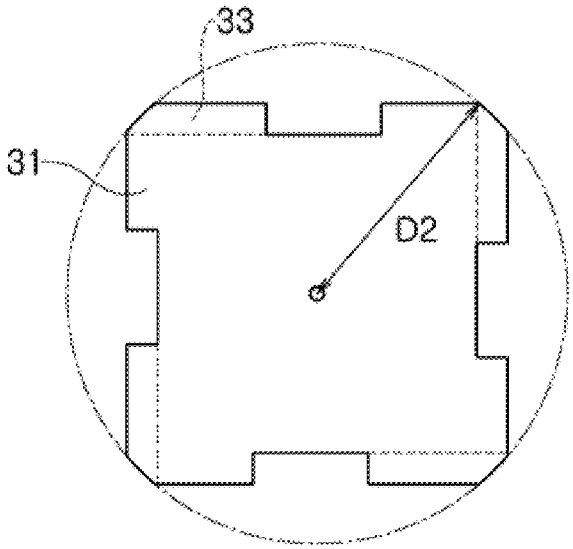

FIG. 4 is a perspective view illustrating a controllable pitch propeller according to an embodiment of the present disclosure. FIG. 5 is an exploded perspective view of the controllable pitch propeller illustrated in FIG. 4. FIGS. 6A to 6C are conceptual views illustrating a relationship in which the pitch of the blades is changed by hydraulic pressure. FIG. 7 is a conceptual view illustrating a force acting on a pin moving along a diagonal guide slot. FIGS. 8A and 8B are graphs illustrating a change in pitch and a magnitude of hydraulic pressure according to movement of a crosshead. FIGS. 9A and 9B are conceptual views comparing the side surface of the crosshead of the controllable pitch propeller according to an embodiment of the present disclosure with the side surface of the crosshead of the conventional controllable pitch propeller.

As shown in FIG. 4, the controllable pitch propeller 100 mounted on the end of the propulsion shaft extending to the stern includes a hub 130 connected to the propulsion shaft, and a plurality of blades 120 mounted around the hub 130 capable of adjusting two pitch angles.

Hereinafter, the drive mechanism of the controllable pitch propeller configured as described above will be described in detail.

As shown in FIGS. 4 and 5, a crosshead 131 capable of moving in the longitudinal direction of the hub 130 is embedded in the hub 130. A guide slot 133 is formed on each side of the crosshead 131 in a direction of movement of the crosshead 131, that is, a diagonal line with respect to the center line of the propulsion shaft. A pin 125 is inserted into the guide slot 133.

As described above, a blade carrier 123 is fixed to the blade shank 121. The pin 125 formed in the blade carrier 123 is inserted into the guide slot 133 of the crosshead 131.

When the crosshead 131 moves in the longitudinal direction of the hub 130, the pin 125 moves along the diagonal guide slot 133. The blade carrier 123 is rotated by the pin 125 moving between both ends of the guide slot 133, that is, the top dead center 133H and the bottom dead center 133L, and the blade pitch is variable according to the rotation of the blade carrier 123.

As shown in FIG. 7, when the pin 125 also moves along the guide slot 133 according to the forward and backward movement of the crosshead 131, the pitch change of the blade 120 and the magnitude of the hydraulic pressure may be calculated by the following Equation 1 and Equation 2.

$$\theta_s = \tan^{-1}\left[\frac{2r_p \sin\theta'_R}{d_{str}}\right] \quad \text{Equation 1}$$

$$F_r = \frac{T_{sp}}{r_p \cos\theta} = \frac{F'_{cyl}}{\tan\theta_s} \quad \text{Equation 2}$$

$$\therefore F'_{cyl} = \frac{2\sin\theta'_R}{d_{str}\cos\theta} T_{sp}$$

Here, $T_{sp}$: spindle torque, $F'_{cyl}$: hydraulic force of hydraulic system, $d_{str}$: stroke of hydraulic system, $\theta_s$: guide slot angle, $\theta'_R$: spindle angle range, $\theta$: spindle angle, $r_p$: distance from pin to spindle center point.

As can be seen from Equations 1 and 2, as the variable angle range of the pitch is smaller and the movement distance of the crosshead 131, that is, the stroke of the hydraulic system 140 is longer, the load of the hydraulic system 140 is reduced.

Meanwhile, a rod 141R is connected to the rear end of the crosshead 131, and a piston 141 of the hydraulic system 140 is fixed to an end of the rod 141R. The piston 141 is located inside the cylinder 143 of the hydraulic system 140 formed at the rear end of the hub 130.

In addition, the hydraulic line 145 extending into the hub 130 communicates with the inside of the cylinder 143 through the piston 141. Therefore, hydraulic oil flows into or out of the cylinder 143 through the hydraulic line 145. As the hydraulic oil flows into the inner rear of the cylinder 143 with respect to the piston 141, or flows into or out of the inner front of the cylinder 143, the piston 141 moves forward or backward. Accordingly, the crosshead 131 connected to the piston 141 is also moved forward and backward by hydraulic pressure.

Hereinafter, a variable relationship of the blade pitch according to stroke expansion and contraction of the hydraulic system will be described with reference to FIGS. 6A to 6C.

As shown in FIG. 6A, when hydraulic oil is introduced into the rear of the piston 141 to extend the stroke of the hydraulic system, the piston 141 moves forward by hydraulic pressure, that is, in the direction of the bow. As the piston 141 moves, the crosshead 131 also moves in the direction of the bow. Accordingly, the pin 125 moves to the top dead center 133H of the guide slot 133, and as the pin 125 moves, the blade 120 rotates clockwise in the drawing of FIG. 6A. When the pin 125 is rotated and positioned at the top dead center 133H, the blade 120 is in a state of maximum rotation clockwise.

In this state, when the hydraulic oil is introduced to the front of the piston 141 while discharging the hydraulic oil supplied to the rear of the piston 141, the piston 141 moves backward. As the piston 141 moves backward, the pin 125 moves from the top dead center 133H to the bottom dead center 133L along the guide slot 133.

At this time, according to the movement of the pin 125, the blade 120 rotates counterclockwise as shown in FIG. 6B. In a state in which the stroke of the hydraulic system is contracted to the maximum, that is, in a state in which the piston 141 moves backward to the maximum inside the cylinder 143, the pin 125 is located at the bottom dead center 133L of the guide slot 133 as shown in FIG. 6C. As described above, according to the movement of the pin 125, the blade 120 is positioned at a point where it is rotated to the maximum counterclockwise.

As described above, while the pin 125 connected to the blade 120 moves along the guide slot 133 formed in a diagonal direction with respect to the propulsion shaft, it is possible to vary two pitches corresponding to the top dead center 133H and the bottom dead center 133L.

According to this drive mechanism, it can be seen that the greater the slope and the longer the length of the guide slot 133, the wider the variable range of the blade pitch. However, in this case, as can be seen from Equation 2, the hydraulic pressure should be increased, and accordingly, the size of the hydraulic system is increased. In addition, in this case, as the crosshead 131 increases, there is a problem that the propulsion efficiency of the propeller is lowered.

Therefore, in the controllable pitch propeller according to the embodiment of the present disclosure, it is preferable to limit the variable range of two pitches of the blade to within 10 degrees.

FIGS. 8A and 8B are graphs relatively illustrating the magnitude of the required hydraulic pressure according to the blade angle of the controllable pitch propeller.

According to the graphs shown in FIGS. 8A and 8B, when the variable range of the blade pitch is within the range of ±10 degrees as in the embodiment of the present disclosure, the required hydraulic pressure is about 100 KN. On the other hand, when the variable range of the blade pitch is in the range of ±35 degrees as in the conventional controllable pitch propeller 10, the required hydraulic pressure is 580 to 720 KN.

As described above, in the case of the controllable pitch propeller according to the embodiment of the present disclosure, the required hydraulic pressure may be reduced by limiting the variable range of the blade pitch to within ±10 degrees. In addition, the size of the hub 130 is reduced by locating the guide slot 133 of the crosshead 131 in a diagonal direction with respect to the propulsion shaft, and thus the blade pitch may be varied to be suitable for two types of operating conditions of the low-speed ship.

As shown in FIG. 9A, in the side surface of the crosshead 131 of the controllable pitch propeller 100 configured in this way, the guide slot 133 is formed in a diagonal direction with respect to the length of the propulsion shaft. Accordingly, only a portion where the guide slot 133 is formed has a protruding structure to be matched with the pin 125. The crosshead 131 has a structure protruding in the lateral direction as many as the number of blades 120. Therefore, the crosshead 131 has a short distance D1 from its center to the outermost side, so that the crosshead 131 has a small side cross-section. As shown in FIG. 9B, a slide groove 33 is formed on the side surface of the conventional crosshead 31 in the vertical direction of the propulsion shaft. Accordingly, the distance D2 from the center of the crosshead 31 to the outermost is longer than the distance of the controllable pitch propeller of the embodiment of the present disclosure. Thus, the side cross-section of the crosshead 31 becomes larger.

As described above, as the cross-sectional area of the crosshead 31 increases, the diameter of the hub 30 also increases. In addition, the hub diameter of the controllable pitch propeller according to the embodiment of the present disclosure is relatively smaller than the hub diameter of the conventional controllable pitch propeller, thereby increasing the propulsion efficiency to a level close to that of the fixed pitch propeller.

Diameter Ratio of Hub and Blade

Figure 10:
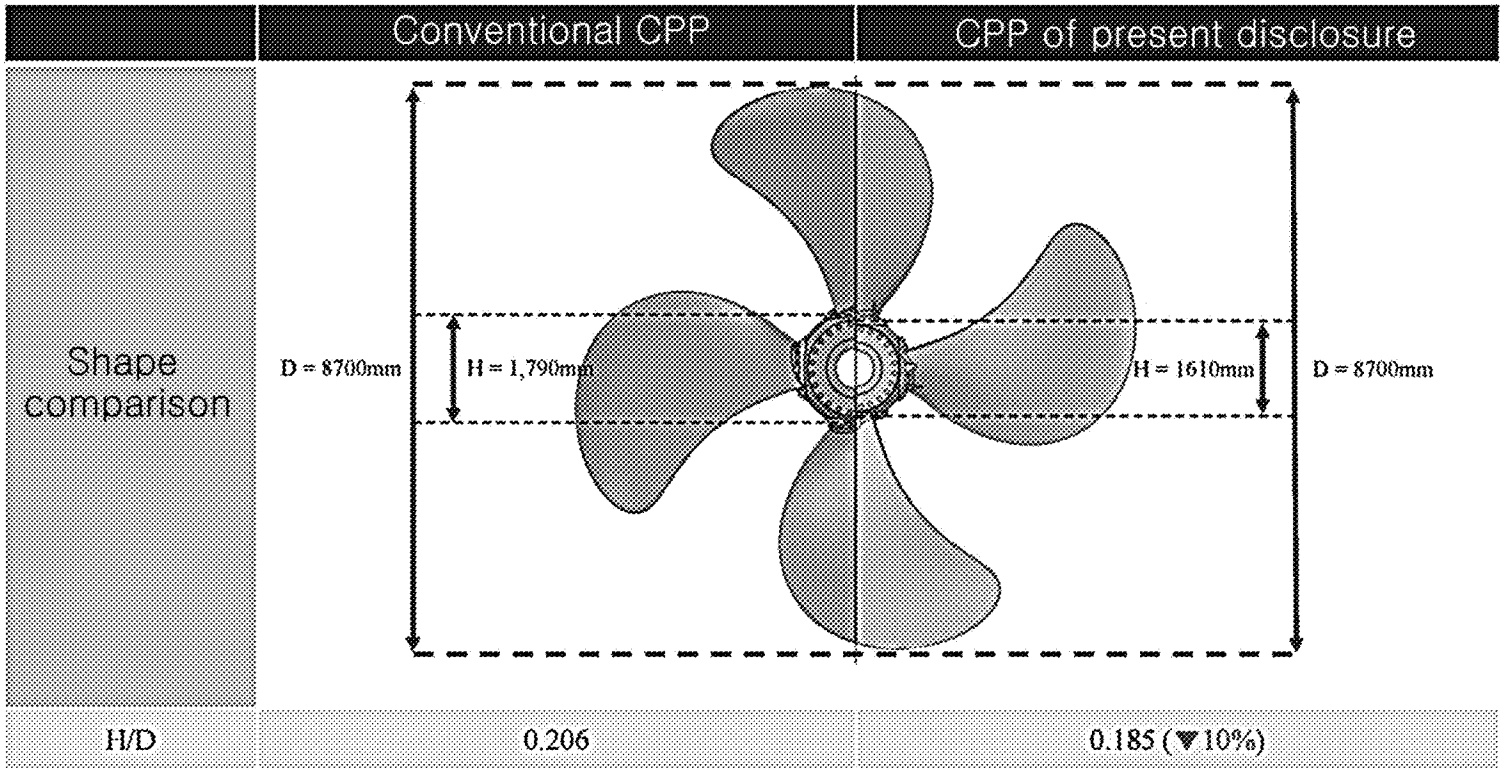
FIG. 10 is a comparative view comparing the hub of the controllable pitch propeller according to the prior art with that of the controllable pitch propeller according to an embodiment of the present disclosure.

FIG. 10 is a comparative view comparing the hub of the controllable pitch propeller according to the prior art with that of the controllable pitch propeller according to an embodiment of the present disclosure.

The propeller illustrated in FIG. 10 shows a conventional controllable pitch propeller (left propeller) including a crosshead having a vertical slide groove according to the prior art and a controllable pitch propeller (right propeller) including a crosshead having a diagonal guide slot according to an embodiment of the present disclosure.

In the case of a controllable pitch propeller having a diameter D of 8,700 mm, a hub diameter H of a conventional controllable pitch propeller is 1,790 mm and the diameter ratio H/D is 0.206. On the other hand, the hub diameter H of the controllable pitch propeller according to an embodiment of the present disclosure is 1,610 mm, and the diameter ratio H/D is 0.185. Therefore, it is possible to reduce about 10% compared to the diameter ratio of the conventional controllable pitch propeller.

Meanwhile, when the hub diameter decreases, the safety factor also decreases. In particular, when the hub diameter decreases by 10%, the safety factor decreases by about 30%, and when the hub diameter decreases by 15%, the safety factor decreases by about 40%.

Here, the safety factor means an evaluation value of fatigue strength according to repeated loads occurring due to the structural characteristics of the propeller and the hub.

Generally, in the case of a conventional controllable pitch propeller, it is possible to reduce up to 15% in consideration of the safety factor margin.

Therefore, when having the same propeller diameter D, the hub diameter H of the controllable pitch propeller according to the present disclosure may be reduced by 5 to 15% compared to the hub diameter H of the conventional controllable pitch propeller.

Moreover, in the case of a controllable pitch propeller having a mechanism according to the present disclosure, if a suitable material of the propeller is selected and replaced, the hub diameter may be reduced by up to 20% compared to the conventional controllable pitch propeller.

Table 1 below shows the ratio of the hub diameter/propeller diameter of the fixed pitch propeller (FPP) and the controllable pitch propeller according to the embodiment of the present disclosure depending on the type and size of the low-speed ship.

TABLE 1

| | | H/D Ratio | |
|---|---|---|---|
| Type of Low-Speed Ship | Size | FPP | CPP according to the present disclosure |
| Tanker | 300-320K Class | 0.155 | 0.165-0.185 |
| | 158K Class | 0.160 | 0.170-0.190 |
| | 114K Class | 0.160 | |
| Bulk Carrier | 180K Class | 0.170 | 0.180-0.200 |
| | 210K Class | | |

As described above, in the controllable pitch propeller according to an embodiment of the present disclosure, the hub diameter may be reduced so that the H/D ratio is 0.165 to 0.190 for a tanker and 0.180 to 0.200 for a bulk carrier in consideration of a reduced safety factor of 40%.

First Embodiment of Locking Device at Each Dead Center

Hereinafter, four types of embodiments of the locking device are described. Among them, the locking device according to the first embodiment relates to a structure where end slots in which a pin may be positioned in the direction of the propulsion axis at both ends of the guide slot, that is, top dead center and bottom dead center are formed.

Figure 11A:
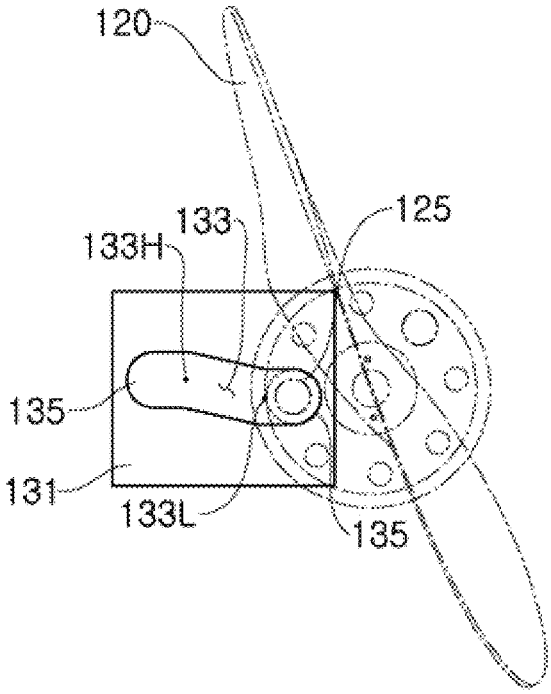
FIGS. 11A and 11B are conceptual views illustrating end slots formed at both ends of a guide slot.
Figure 11B:
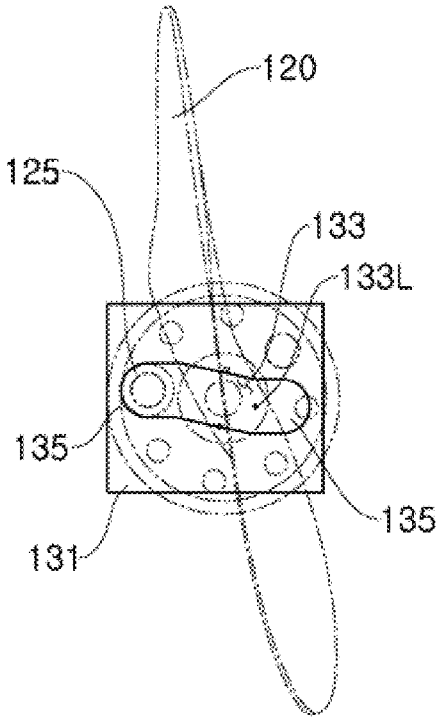
Figure 12:
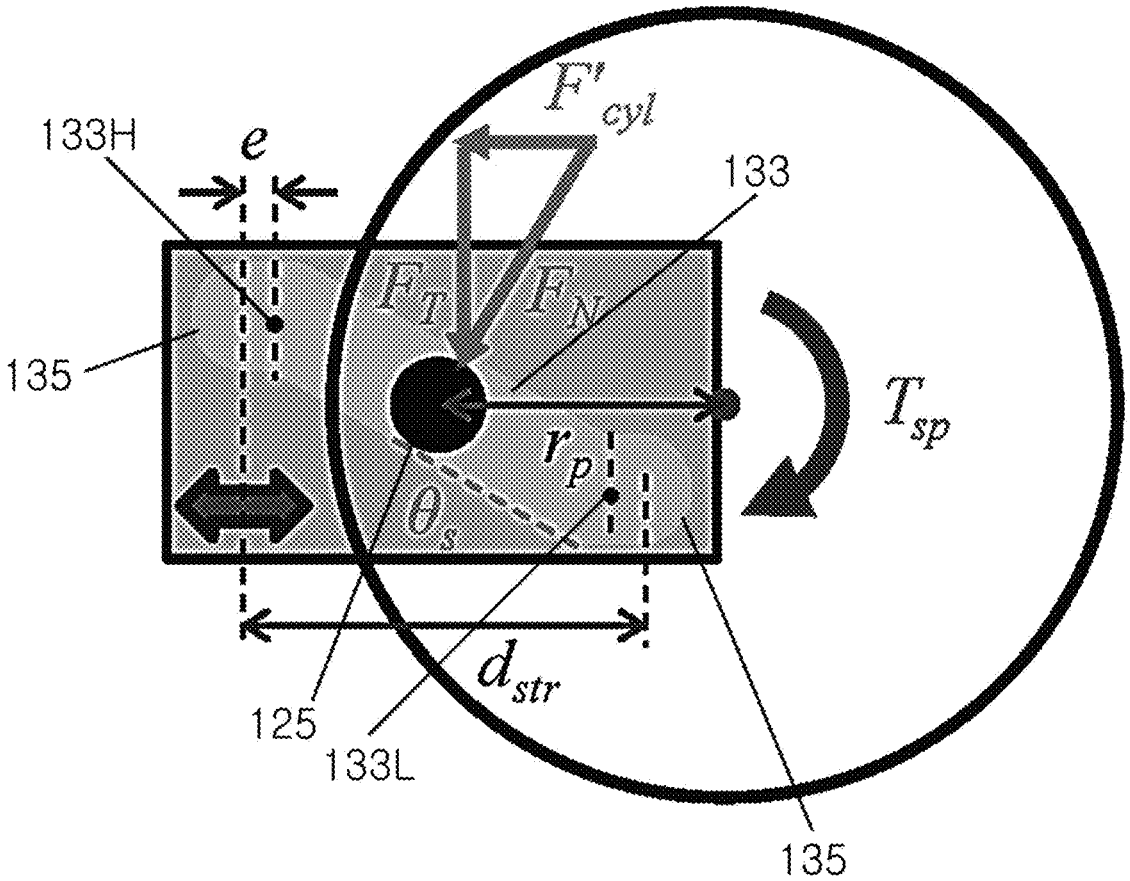
FIG. 12 is a conceptual view illustrating a force acting on a pin moving along an end slot and a guide slot.
Figure 13:
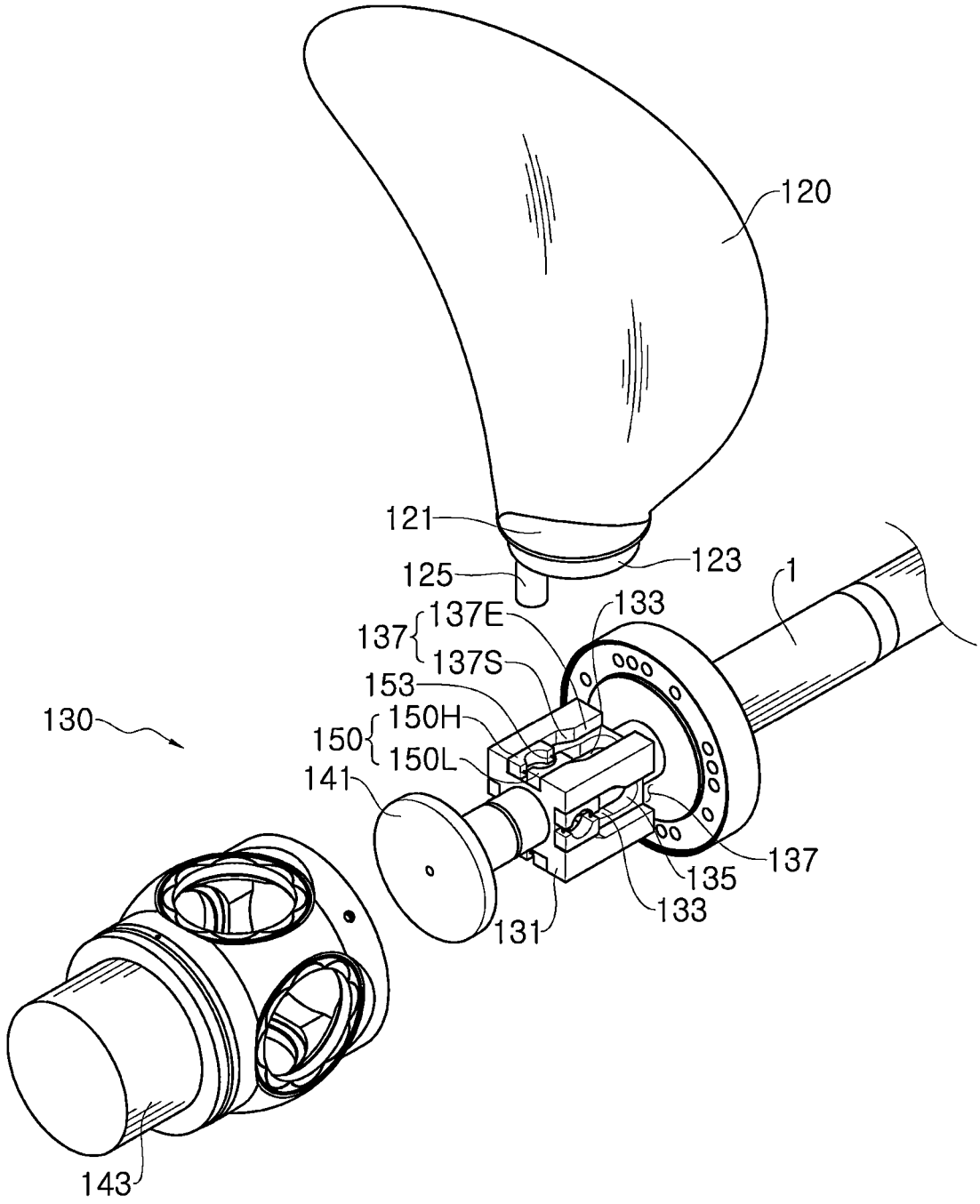
FIG. 13 is an exploded perspective view illustrating an example in which a sliding shoe is mounted on the pin shown in FIG. 12.
Figure 14A:
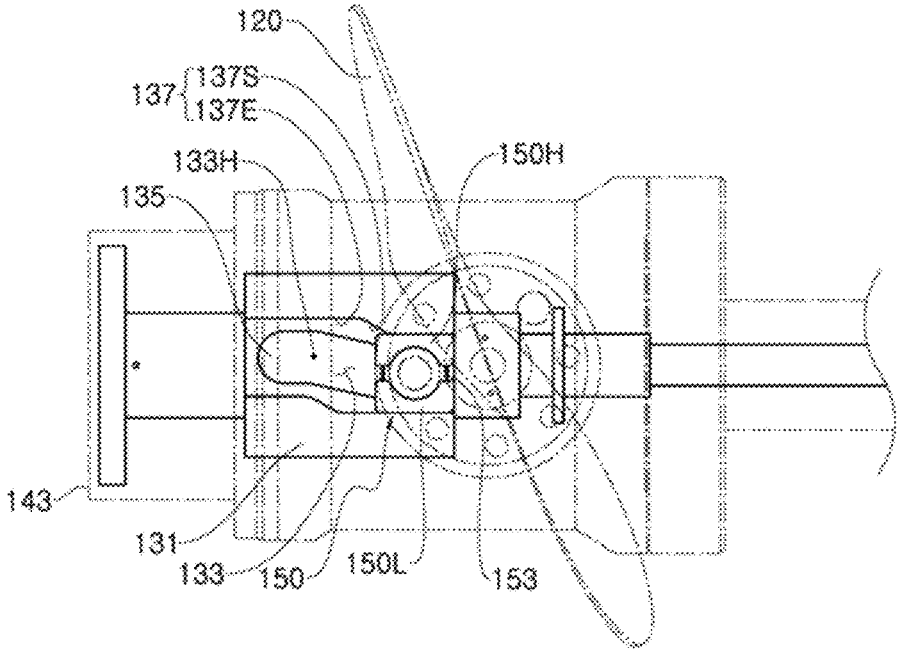
FIGS. 14A and 14B are conceptual views illustrating a relationship in which the sliding shoe shown in FIG. 13 moves along the second guide slot following the pin.
Figure 14B:
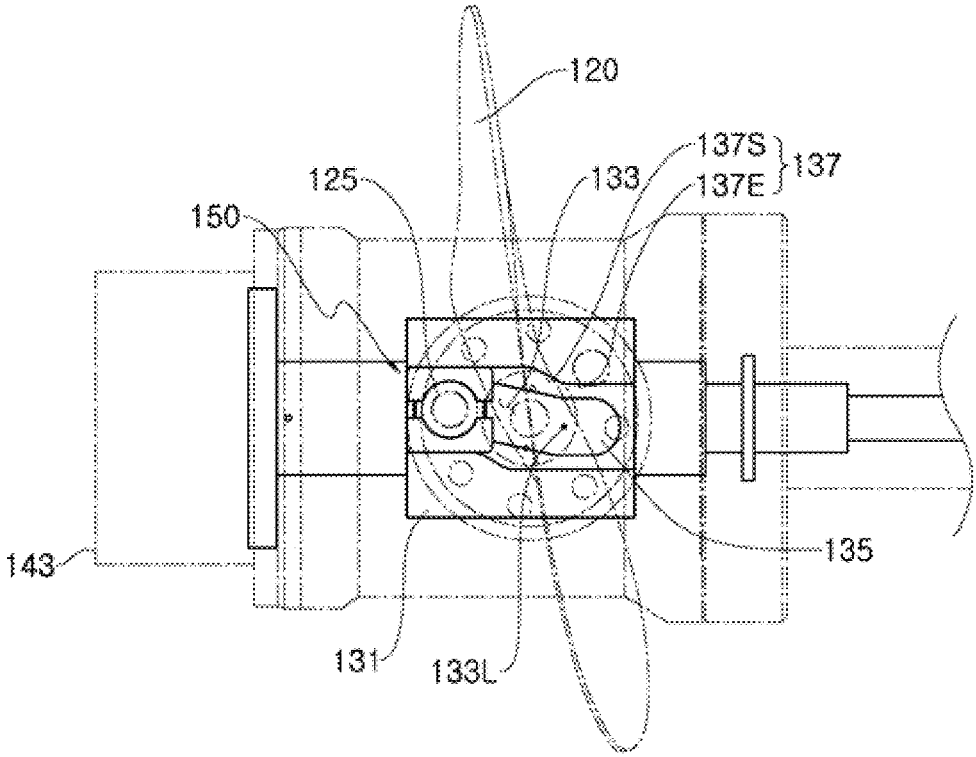

FIGS. 11A and 11B are conceptual views illustrating end slots formed at both ends of a guide slot. FIG. 12 is a conceptual view illustrating a force acting on a pin moving along an end slot and a guide slot. FIG. 13 is an exploded perspective view illustrating an example in which a sliding shoe is mounted on the pin shown in FIG. 12. FIGS. 14A and 14B are conceptual views illustrating a relationship in which the sliding shoe shown in FIG. 13 moves along the second guide slot following the pin.

As shown in FIGS. 11A and 11B, end slots 135 are further formed at both ends of the guide slot 133 in the outward direction of the guide slot 133 along the center line of the propulsion shaft.

The pin 125 moving along the guide slot 133, in a state of reaching the top dead center 133H or the bottom dead center 133L of the guide slot 133, enters the end slot 135 extended from the top dead center 133H or the end slot 135 extended from the bottom dead center 133L by the movement of the crosshead 131, and is located. Conversely, it enters the guide slot 133 from the end slot 135 by the movement of the crosshead 131, and moves toward the opposite end slot 135.

To this end, the end slot 135 is formed to communicate with the guide slot 133 in a groove structure having a length (e in FIG. 12) greater than or equal to the radius of the pin 125 along the center line of the propulsion shaft at both ends of the guide slot 133. When the pin 125 is positioned in the end slot 135, more than half of the cross-sectional area of the pin 125 is positioned inside the end slot 135.

Therefore, when the pin 125 enters the end slot 135 and is positioned, the outer peripheral surface of the pin 125 is not in contact with the inner surface of the guide slot 133, but is in contact with the inner surface of the end slot 135.

In this case, even if the resistance generated during the rotation of the controllable pitch propeller 100 is transmitted to the pin 125 through the blade 120, the direction in which the resistance acts and the longitudinal direction of the end slot 135 are perpendicular to each other, and thus it is possible to prevent the pin 125 from entering the guide slot 133 and moving along the guide slot 133 by the resistance. As the pin 125 is positioned and locked in the end slot 135 in this way, it is possible to prevent the blade pitch from being varied by the resistance. In addition, the hydraulic pressure of the hydraulic system 140 limiting the flow of the crosshead 131 may be reduced accordingly, and the size of the hub 130 may be reduced.

When the end slots 135 are respectively formed at both ends of the guide slot 133, the movement distance is increased beyond the diameter of the pin 125 than the movement distance of the crosshead along the guide slot in which the end slot is not formed as shown in FIGS. 5 to 6C. That is, as the end slots 135 are formed at both ends of the guide slot 133, respectively, the stroke of the hydraulic system 140 is further increased beyond the diameter of the pin 125.

As shown in FIG. 12, when the pin 125 moves along the end slot 135 and the guide slot 133 according to the forward and backward movement of the crosshead 131, the pitch change of the blade 120 and the magnitude of the hydraulic pressure may be calculated by Equation 3 below.

$$d_{astr} = d_{str} - 2e \qquad \text{Equation 3}$$

$$\theta_s = \tan^{-1}\left[\frac{2\sin\theta'_R r_p}{d_{astr}}\right]$$

$$F_r = \frac{T_{sp}}{r_p\cos\theta} = \frac{F'_{cyl}}{\tan\theta_s}$$

$$\therefore F'_{cyl} = \frac{2\sin\theta'_R}{d_{astr}\cos\theta}T_{sp}$$

Here, e: length of end slot, $T_{sp}$: spindle torque, $F'_{cyl}$: hydraulic force of hydraulic system, $d_{str}$: full stroke of hydraulic system, $d_{astr}$: stroke of hydraulic system for pitch control, $\theta_s$: guide slot angle, $\theta'_R$: spindle angle range, $r_p$: distance from pin to spindle center point.

As can be seen from Equation 3, as the variable angle range of the pitch is smaller and the movement distance of the crosshead 131, that is, the stroke of the hydraulic system 140 is longer, the load of the hydraulic system 140 is reduced. In addition, as the pin 125 is positioned and locked in the end slot 135 formed by extending to the top dead center and the bottom dead center of the guide slot 133, the hydraulic pressure corresponding to the resistance may be greatly reduced, thereby greatly reducing the capacity of the hydraulic system 140.

Meanwhile, the pin 125 has a cylindrical structure as shown in FIGS. 11 and 12. Therefore, when an external shock or the like is suddenly applied to the pin 125 located in the end slot 135, there is a problem that the blade pitch may be varied by moving from the end slot 135 to the guide slot 133.

In order to solve this problem, as shown in FIGS. 13 and 14, the sliding shoe 150 is mounted around the pin 125. In addition, a second guide slot 137 for guiding the sliding shoe 150 moving along the pin 125 is formed in the crosshead 131.

Specifically, the sliding shoe 150 is divided into an upper sliding shoe 150 and a lower sliding shoe 150, and a groove 151 in contact with the outer circumferential surface of the pin 125 is formed on the surface in which the upper sliding shoe 150 and the lower sliding shoe 150 face so that the pin 125 is positioned between the upper sliding shoe 150 and the lower sliding shoe 150. And, on the outside of the groove 151, a coil spring 153 is positioned between the upper sliding shoe 150 and the lower sliding shoe 150 to compensate for the width change of the second guide slot 137 when the sliding shoe 150 moves along the second guide slot 137. Although not shown in FIGS. 13 and 14, a groove into which the end of the coil spring 153 is inserted or a pin inserted into the coil spring is formed in the coil spring sheet in order to fix the position of the coil spring 153, so that the position of the coil spring may be fixed.

Meanwhile, the second guide slot 137 is formed on the side surface of the crosshead 131, and the guide slot 133 described above is formed on the bottom surface of the second guide slot 137. And, in a state where the pin 125 is inserted into the sliding shoe 150 located in the second guide slot 137, the end of the pin 125 is inserted into the guide slot 133.

Here, the second guide slot 137 is divided into a diagonal portion 137S formed at the same slope as the diagonal line of the guide slot 133, and an end portion 137E corresponding to the end slot 135 formed at both ends of the guide slot 133. The end portion 137E is formed along the center line of the propulsion shaft like the end slot 135.

As the second guide slot 137 is formed in this way and the crosshead 131 on which the sliding shoe 150 is mounted moves forward and backward by the operation of the hydraulic system 140, the pin 125 is moved from the guide slot 133 to the end slot 135 or from the end slot 135 to the guide slot 133. By the movement of the pin 125, the sliding shoe 150 also moves along the diagonal portion 137S and the end portion 137E of the second guide slot 137.

Since the sliding shoe 150 has a structure surrounding the pin 125, the width of the second guide slot 137 is wider than that of the guide slot 133. The end portion 137E of the second guide slot 137 corresponding to the end slot 135 is also formed to be longer than the length (e in FIG. 12) of the end slot 135.

In this structure, when the pin 125 is positioned in the end slot 135, the sliding shoe 150 is positioned at both ends 137E of the second guide slot 137. While positioned at the end portion 137E of the second guide slot 137 formed along the center line of the propulsion shaft, the contact surface between the sliding shoe 150 and the end portion 137E of the second guide slot 137 is perpendicular to the rotation direction of the propeller 100.

As the contact surface between the sliding shoe 150 and the end of the second guide slot 137 is perpendicular to the rotation direction of the propeller 100, even if an external impact is applied, the sliding shoe 150 does not deviate from the second guide slot 137 by the impact. Thus, the pin 125 is also stably positioned in the end slot 135.

Meanwhile, when the sliding shoe 150 moves from the end portion 137E of the second guide slot 137 to the diagonal portion 137S or from the diagonal portion 137S to the end portion 137E, the width of the second guide slot 137 is changed at the bent portion where the end portion 137E and the diagonal portion 137S meet. Accordingly, as the sliding shoe 150 passes through the bent portion, the coil spring 153 located between the upper sliding shoe 150 and the lower sliding shoe 150 is elastically deformed to compensate for the change in width. Therefore, the sliding shoe 150 smoothly passes from the end portion 137E to the diagonal portion 137S or from the diagonal portion 137S to the end portion 137E.

In this way, the end slots 135 are formed at both ends of the guide slot 133 and the pin 125 is positioned in the end slot 135 to reduce the resistance according to the rotation of the propeller 100, thereby reducing the capacity of the hydraulic system 140. In addition, when the sliding shoe 150 is mounted and the pin 125 is positioned in the end slot 135, the outer surface of the sliding shoe 150 and the inner surface of the end of the second guide slot 137 are in surface contact, and thus it is possible to effectively block the separation of the pin 125 from the end slot 135 due to external impact, or the like.

Second Embodiment of Locking Device at Each Dead Center

The locking device according to the second embodiment to be described below locks the forward and backward movement of the crosshead when the pin is positioned at the top dead center and bottom dead center in the forward and backward movement of the crosshead, thereby preventing the blade pitch from being varied due to external resistance and impact.

The locking device according to the second embodiment is a mechanism in which the locking mechanism of the locking device (in FIGS. 11 to 14) of the first embodiment described above is different. In describing the locking device of the second embodiment, it may be configured such that the locking device of the first embodiment may or may not be added to the locking device of the second embodiment. The locking device of the second embodiment described below is described with reference to the drawings in which the locking device of the first embodiment is added.

Figure 15:
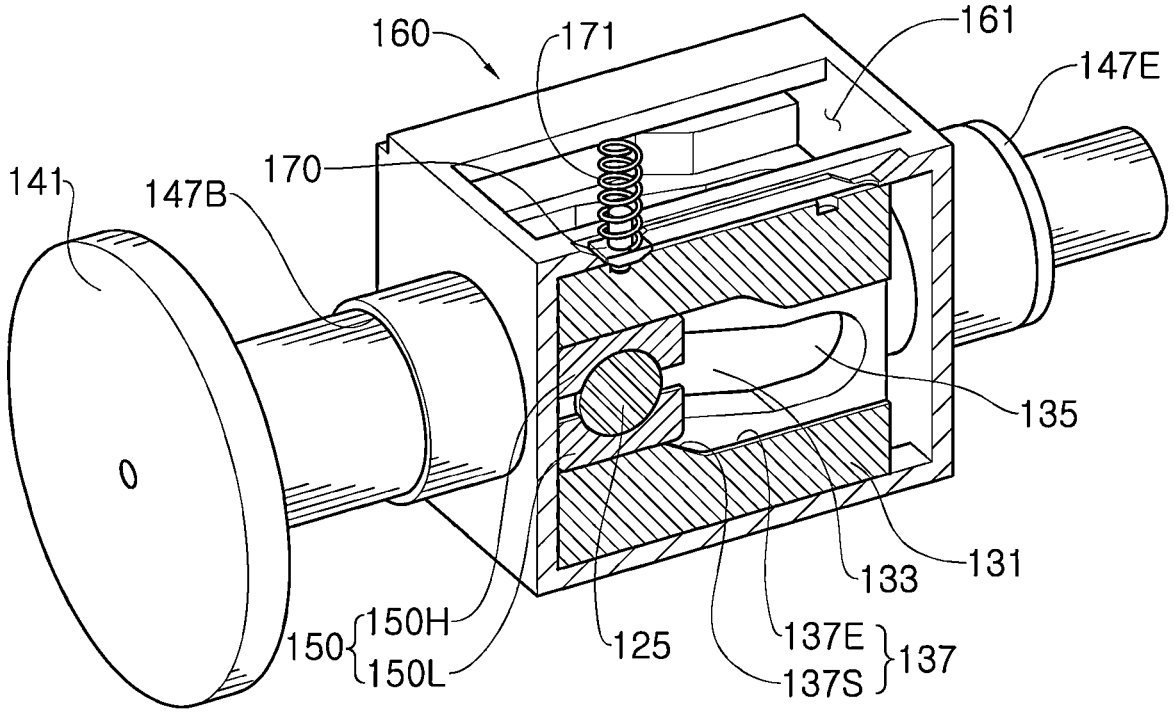
FIG. 15 is a conceptual view illustrating a controllable pitch propeller having a slide lock block according to an embodiment of the present disclosure.
Figure 16:
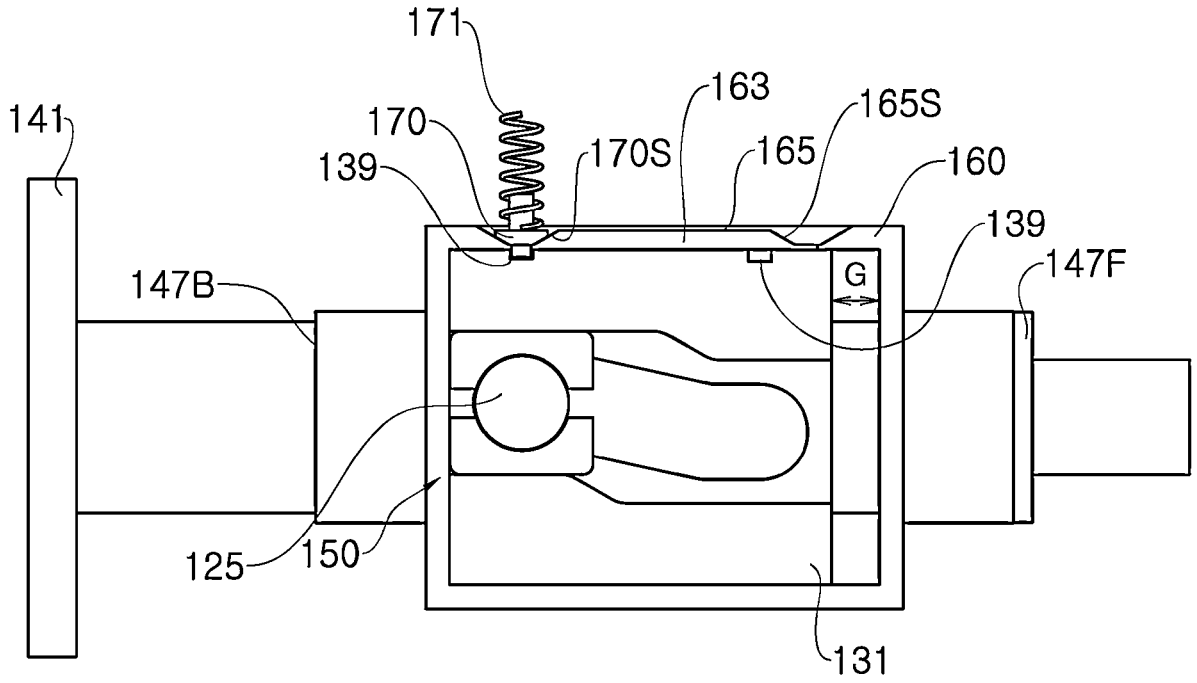
FIG. 16 is a cross-sectional view of the slide lock block shown in FIG. 15.
Figure 17:
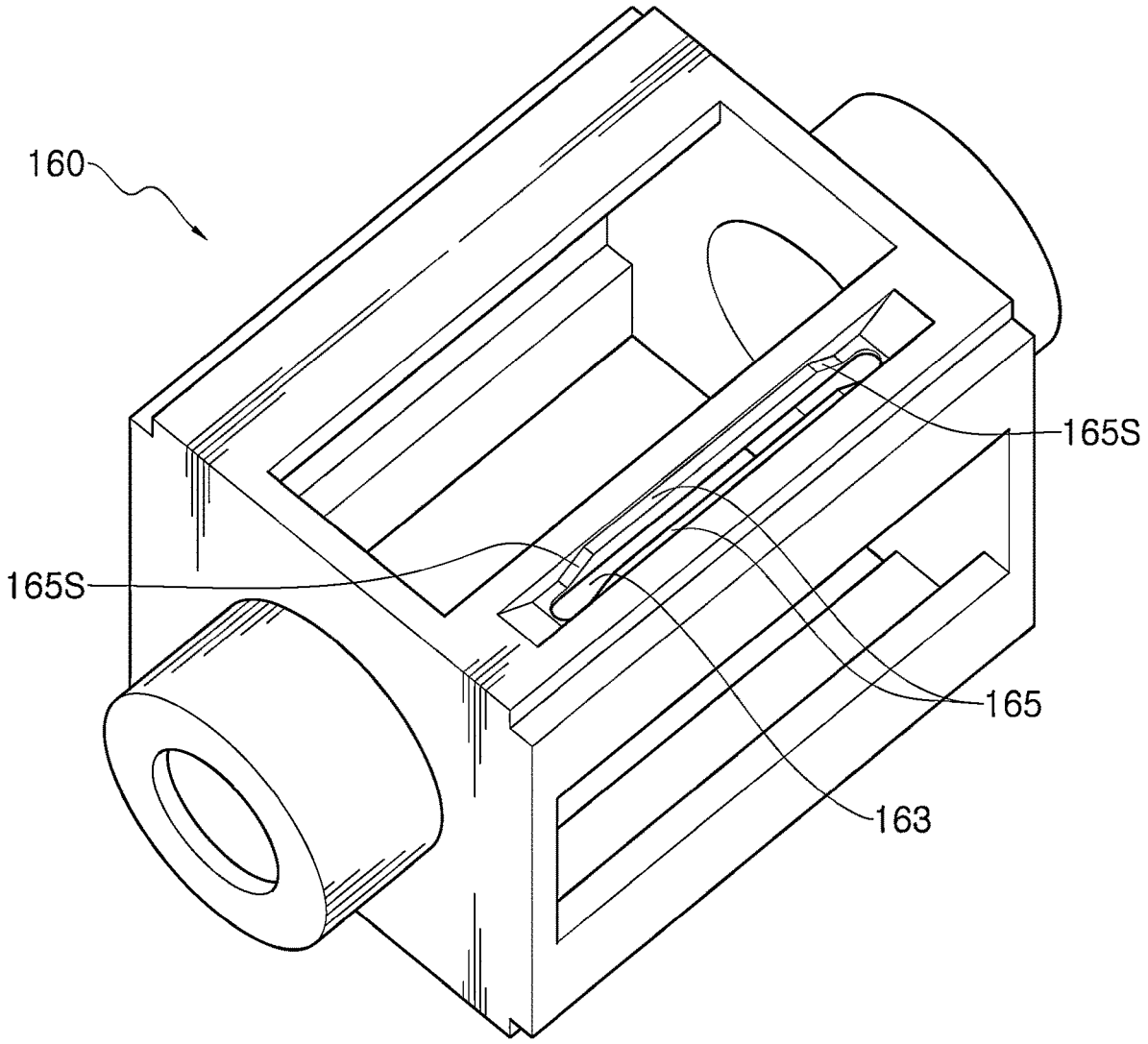
FIG. 17 is an exploded perspective view of the slide lock block shown in FIG. 15.
Figure 18A:
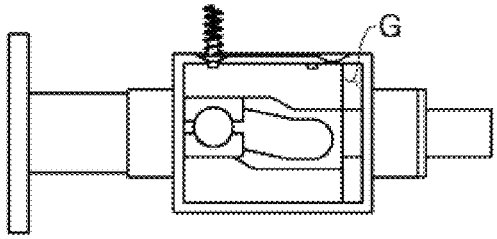
FIG. 18A to 18E are conceptual views illustrating the operation relationship of the slide lock block.
Figure 18B:
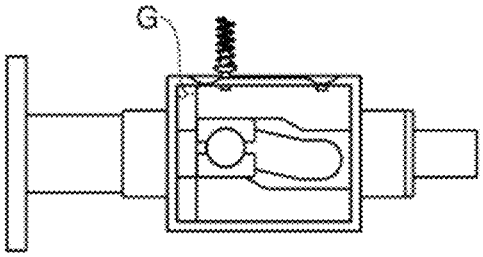
Figure 18C:
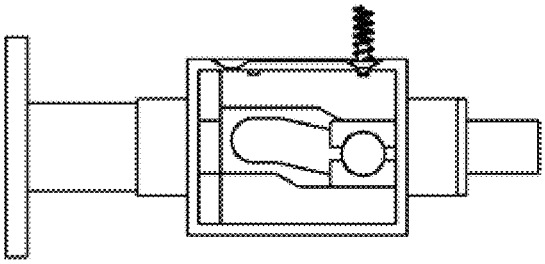
Figure 18D:
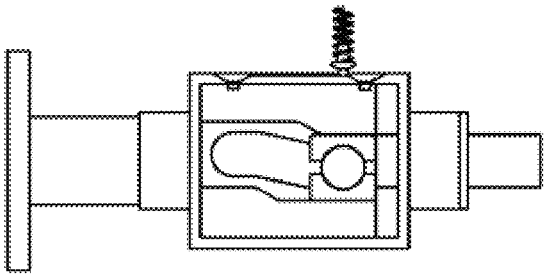
Figure 18E:
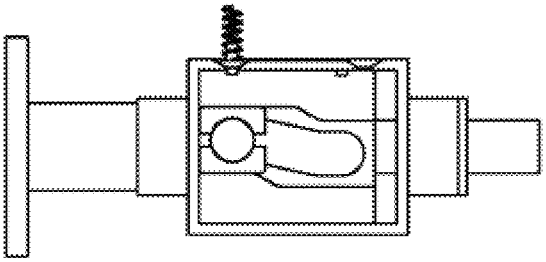

In the drawings, FIG. 15 is a conceptual view illustrating a controllable pitch propeller having a locking device according to an embodiment of the present disclosure. FIG. 16 is a cross-sectional view of the slider shown in FIG. 15. FIG. 17 is an exploded perspective view of the slider shown in FIG. 15. FIG. 18A to 18E are conceptual views illustrating the operation relationship of the slider.

As shown in FIGS. 15 to 17, the rod 141R extending to the front of the piston 141 is positioned to pass through the crosshead 131 in its longitudinal direction. That is, the crosshead 131 is positioned around the rod 141R, and the crosshead 131 may move in the longitudinal direction of the rod.

Meanwhile, the slider 160 is positioned to be movable along the rod 141R, and the crosshead 131 is positioned inside the slider 160, but the length of the slider 160 is longer than that of the crosshead 131. Therefore, the crosshead 131 may move along the rod 141R inside the slider 160 by a length difference. In a state where the crosshead 131 moves by a length difference, the crosshead 131 and the slider 160 are in contact with each other.

In the structure of the locking device configured as described above, when the rod 141R is moved by the operation of the hydraulic system 140, the slider 160 is positioned in contact with the front stopper 147F and the rear stopper 147B. Therefore, the slider 160 moves together with the rod 141R. The crosshead 131 located inside the slider 160 moves along with the movement of the rod 141R from the moment it comes into contact with the crosshead 131 after the slider 160 moves by the length difference.

Meanwhile, an opening 161 is formed on the side of the slider 160 in the longitudinal direction so that the pin 125 is inserted into the guide slot 133 to move between the top dead center 133H and the bottom dead center 133L. Therefore, even if the slider 160 surrounds the crosshead 131, the pin 125 may move within the opening 161 of the slider 160, so that the blade pitch is varied as described above.

In addition, the slider 160 moves along the rod 141R in the same manner as the movement of the piston 141 with both ends in contact with the front stopper 147F and the rear stopper 147B. That is, the slider 160 moves together with the movement of the piston 141 according to the operation of the hydraulic system 140. The crosshead 131 located inside the slider 160 moves along the rod 141R together with the slider 160 when the inner gap G with the slider 160 is narrowed and in contact with each other.

Here, the description of the variation of the blade pitch according to the forward and backward movement of the crosshead is the same as described above, and thus will be omitted.

As shown in FIG. 18A to 18E, the locking device according to the second embodiment includes a long groove 163 formed on the side of the opening 161 in the longitudinal direction of the slider 160, two locking holes 139 formed in the crosshead 131 corresponding to both ends of the long groove 163, and a plug 170 that passes though the long groove 163 in a state of being supported on the inner surface of the hub 130, is inserted into and locks the corresponding locking hole 139, and is withdrawn and unlocks. The plug 170 is inserted into or withdrawn from the locking hole 139 as the rail 165 formed inside the long groove 163 of the slider 160 moves in the longitudinal direction.

More specifically, the interval between the locking holes 139 formed in the crosshead 131 is the same as the distance between the top dead center 133H and the bottom dead center 133L of the pin 125. Therefore, when the pin 125 is located at the top dead center 133H or the bottom dead center 133L, the plug 170 corresponds to any one of the two locking holes 139. In addition, the plug 170 is inserted into the locking hole 139 to lock the slider 160 and the crosshead 131 to each other.

Meanwhile, in the case of the slider 160 surrounding the crosshead 131, a long groove 163 into which the plug 170 is inserted is formed in the longitudinal direction of the slider 160. Also, the plug 170 is always provided with an elastic force in the direction of being inserted into the locking hole 139 by the coil spring 171 in a state of being inserted into the long groove 163.

In addition, a pair of rails 165 are formed in the long groove 163 to guide the plug 170 upward to be withdrawn from the locking hole 139 of the crosshead 131. Also, the long groove 163 is formed between the pair of rails 165. At both ends of the rail 165, inclined portions 165S that are gradually lowered toward the outside are formed. Therefore, while the plug 170 moves along the inclined portion 165S, it moves upward or moves downward where the locking hole 139 is located.

On both end surfaces of the plug 170 mounted on the pair of rails 165, inclined surfaces 170S corresponding to the inclined portions 165S of the rail 165 are formed. Therefore, when the slider 160 moves forward and backward in a state that the plug 170 is positioned in the middle of the length of the rail 165, the plug 170 relatively moves along the rail 165. In addition, when reaching the inclined portion 165S of the rail 165, the plug 170 moves downward along the inclined portion 165S by the elastic force of the coil spring 171. Accordingly, the plug 170 is inserted into the locking hole 139 of the crosshead 131 through the long groove 163. Accordingly, the crosshead 131 is locked to the slider 160.

As described above, the locking hole 139 is formed at a position corresponding to the plug 170 when the pin 125 is located at the top dead center 133H and the bottom dead center 133L, and thus the pin 125 is in a state located at top dead center or bottom dead center when the plug 170 is drawn into the locking hole 139. In this state, even if resistance or an external shock is transmitted through the pin 125, it is possible to block the separation of the pin 125 from the top dead center 133H or the bottom dead center 133L.

Meanwhile, in the locked state in which the plug 170 is inserted into the locking hole 139, when the slider 160 moves by the internal gap G caused by the difference in length of the crosshead 131, the plug 170 inserted into the locking hole 139 moves upward along the inclined portion 165S of the rail 165. Also, the plug 170 is withdrawn from the locking hole 139 of the crosshead 131 and unlocked.

In this way, when the slider 160 moves to narrow the inner gap and comes into contact with the crosshead 131 in an unlocked state where the plug 170 is withdrawn from the locking hole 139, the slider 160 and the crosshead 131 move together along the rod 141R. That is, the blade pitch is varied while the crosshead 131 moves along the rod 141R in the unlocked state.

In this state, when the plug 170 moved along the rail 165 reaches the opposite end of the rail 165, it moves downward along the inclined portion 165S. The plug 170 is inserted into the locking hole 139 opposite to the crosshead 131 through the long groove 163 to be locked.

As described above, the locking hole 139 is formed at a point corresponding to the plug 170 when the crosshead 131 moves and the pin 125 is positioned at the top dead center 133H and the bottom dead center 133L. Accordingly, when the plug 170 passes through the long groove 163 and is inserted into the locking hole 139 of the crosshead 131, it means that the plug 170 is locked at the top dead center 133H or the bottom dead center 133L.

in this way, when the pin 125 is positioned at the top dead center 133H and the bottom dead center 133L, the plug 170 passes through the slider 160 and is inserted into the locking hole 139 of the crosshead 131 to be locked. Accordingly, the crosshead 131 is constrained to the slider 160, and the slider 160 is constrained to the rod 141R by the front stopper 147F and the rear stopper 147B. Therefore, it is possible to block the movement of the crosshead 131 by a force other than hydraulic pressure of the hydraulic system 140, that is, resistance and external impact generated according to the rotation of the propeller 100.

Therefore, it is possible to prevent the blade pitch set by the top dead center 133H and the bottom dead center 133L from being displaced by resistance and external impact.

Third Embodiment of Locking Device at Each Dead Center

The locking device according to the third embodiment to be described below locks the forward and backward movement of the crosshead when the pin is positioned at the top dead center and bottom dead center in the forward and backward movement of the crosshead, thereby preventing the blade pitch from being varied due to external resistance and impact. In particular, the first embodiment, the second embodiment described above, and the fourth embodiment to be described later of the locking device are configured to be mounted inside the hub, whereas the third embodiment of the locking device described below is mounted on the propulsion shaft.

Figure 19:
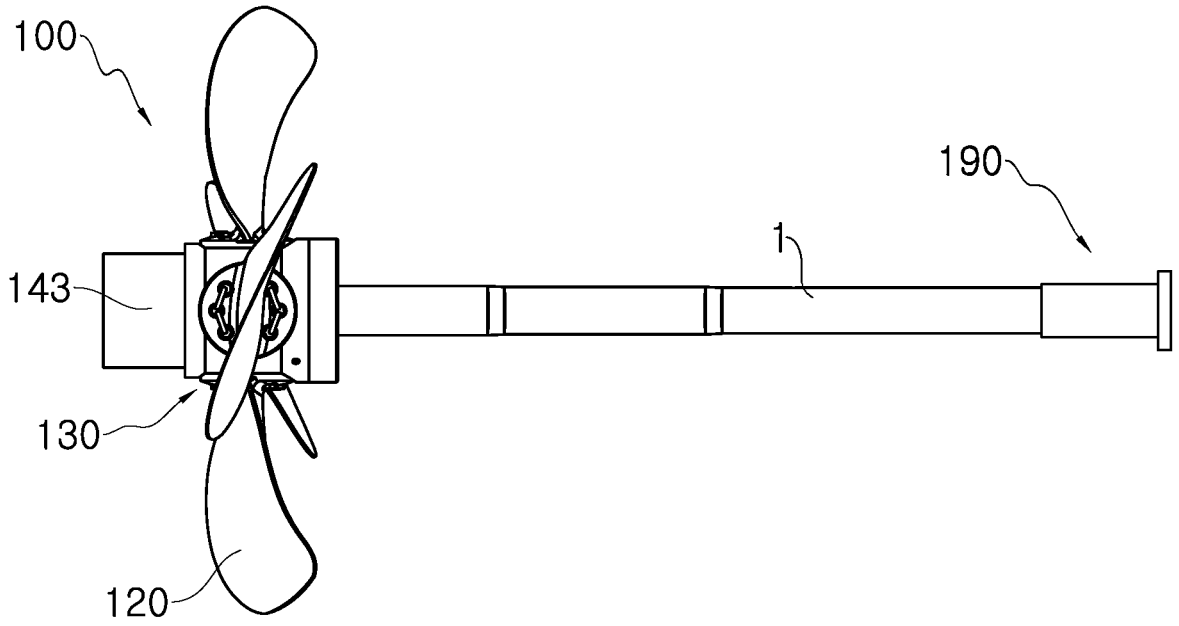
FIG. 19 is a conceptual view illustrating a controllable pitch propeller according to an embodiment of the present disclosure.
Figure 20:
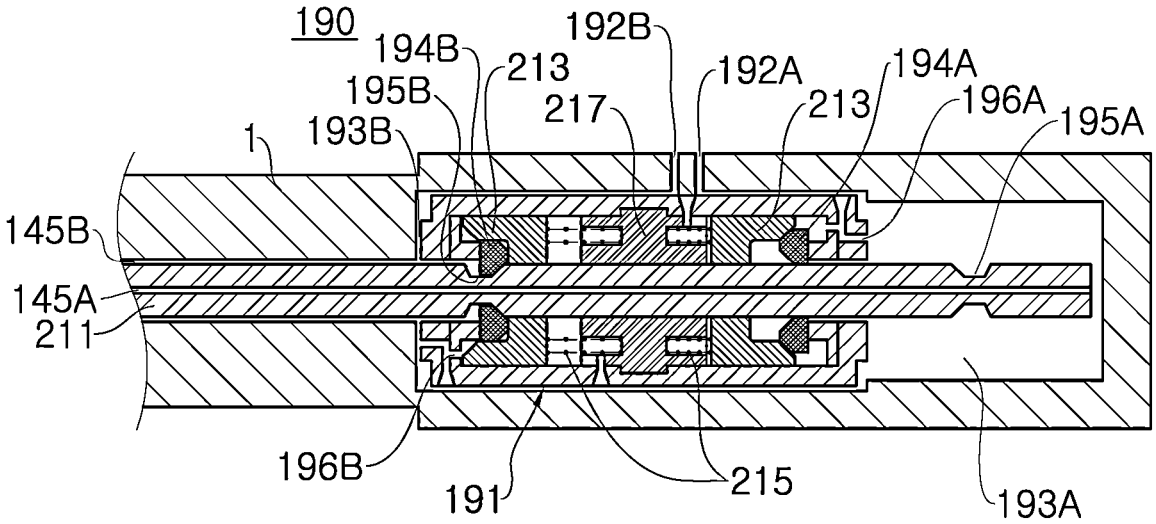
FIG. 20 is a conceptual view illustrating a hydraulic locking unit mounted on the oil distribution box shown in FIG. 19.
Figure 21:
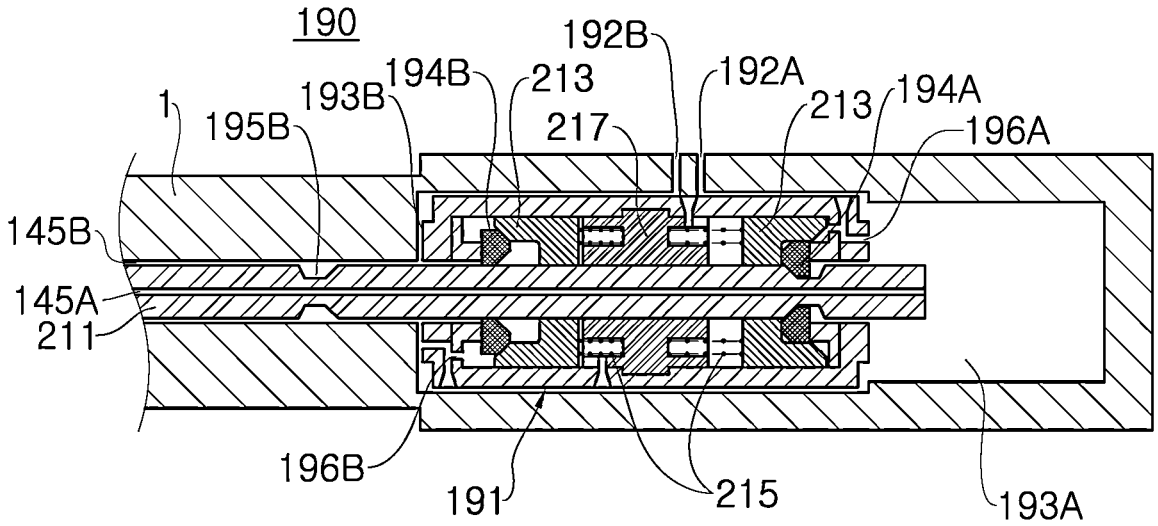
FIG. 21 is a conceptual view illustrating the operation of the hydraulic locking unit in FIG. 20.
Figure 22A:
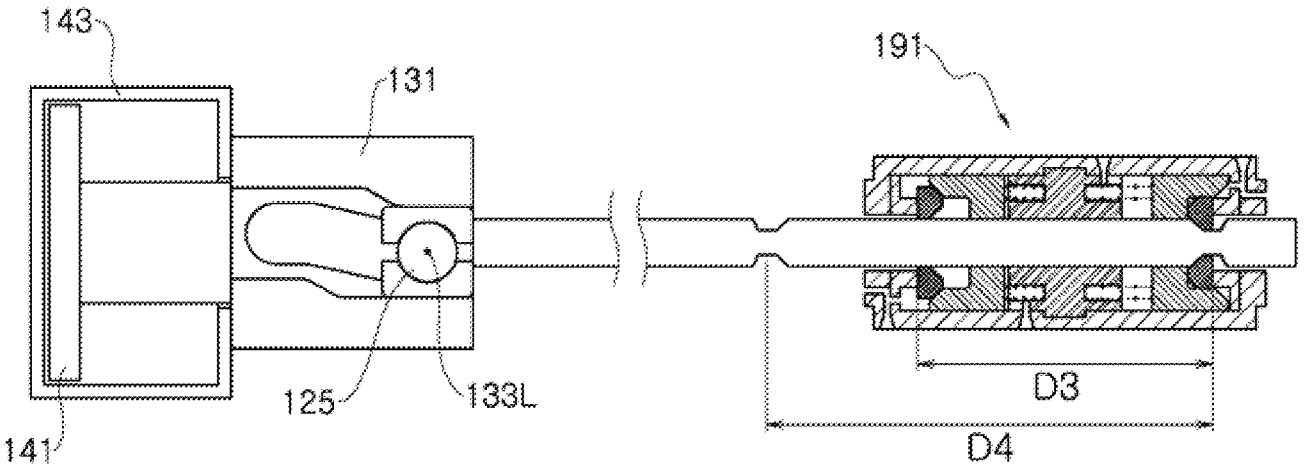
FIGS. 22A and 22B are conceptual views illustrating the operation relationship of the piston, the crosshead, and the hydraulic locking unit at a dead center.
Figure 22B:
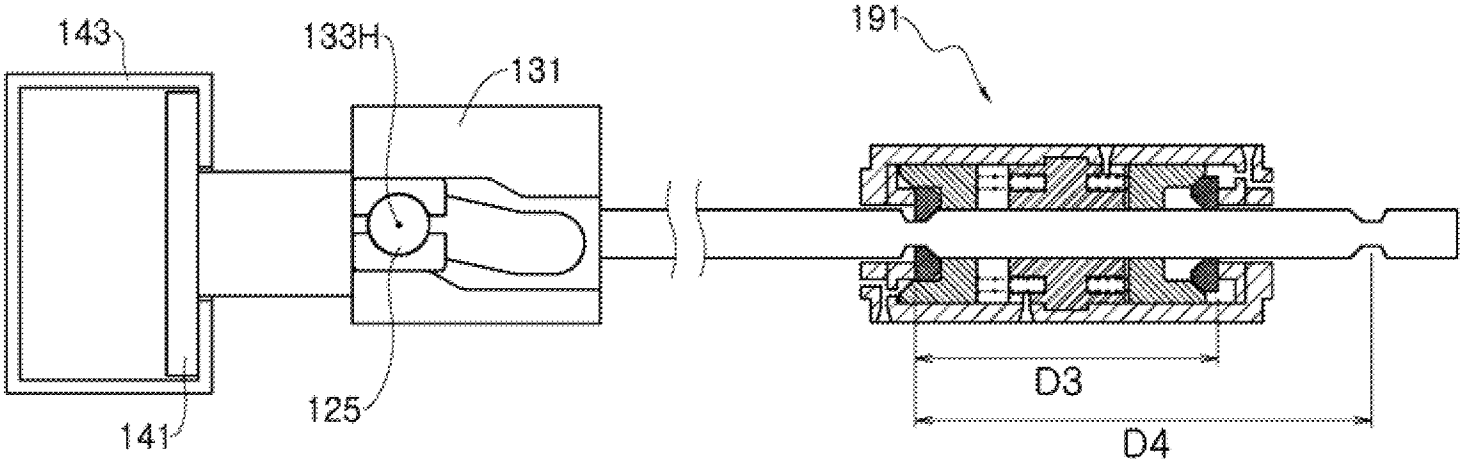

In the drawings, FIG. 19 is a conceptual view illustrating a controllable pitch propeller according to an embodiment of the present disclosure. FIG. 20 is a conceptual view illustrating a hydraulic locking unit mounted on the oil distribution box shown in FIG. 19. FIG. 21 is a conceptual view illustrating the operation of the hydraulic locking unit in FIG. 20. FIGS. 22A and 22B are conceptual views illustrating the operation relationship of the piston, the crosshead, and the hydraulic locking unit at a dead center.

As shown in FIG. 19, the blade 120 is mounted around the hub 130 in the controllable pitch propeller 100. The hub 130 is fixed to the end of the propulsion shaft 1. Also, an oil distribution box 190 is mounted on the propulsion shaft 1.

Ports 192A, 192B through which the hydraulic oil of the hydraulic system 140 flows in and out are formed in the oil distribution box 190. The piston 141 moves forward and backward by the hydraulic oil flowing in and out through the ports 192A, 192B.

Hereinafter, the structure of the propulsion shaft 1 and the hydraulic locking unit 191 mounted inside the oil distribution box 190 to hydraulically lock the movement of the piston 141 will be described in detail.

A hollow is formed inside the propulsion shaft 1, and a concentric hollow shaft 211 connected to the piston 141 is located in the hollow of the propulsion shaft 1. Also, the first hydraulic line 145A is formed along the center line of the hollow shaft 211, and the interval between the outer circumferential surface of the hollow shaft 211 and the hollow inner circumferential surface of the propulsion shaft 1 corresponds to the second hydraulic line 145B. The first hydraulic line 145A passes through the center of the piston 141 and communicates with the rear inside the cylinder 143. The second hydraulic line 145B extends to the front of the piston 141 and communicates with the front inside the cylinder 143.

Therefore, when the hydraulic oil flows into the cylinder 143 through the first hydraulic line 145A, the piston 141 moves forward and the stroke of the hydraulic system 140 is extended. In addition, the hydraulic oil filled in the front inside the cylinder 143 flows toward the oil distribution box 190 through the second hydraulic line 145B. Conversely, when the hydraulic oil flows into the cylinder 143 through the second hydraulic line 145B, the stroke of the hydraulic system 140 is contracted while the piston 141 moves backward. Also, the hydraulic oil filled in the rear inside the cylinder 143 flows toward the oil distribution box 190 through the first hydraulic line 145A.

The hollow shaft 211 connected to the piston 141 moves forward and backward together along the piston 141.

Meanwhile, the hydraulic locking unit 191 is mounted inside the oil distribution box 190, and the hollow shaft 211 passes through the hydraulic locking unit 191 and extends to the front of the hydraulic locking unit 191.

Meanwhile, as shown in FIGS. 20 to 22, the hydraulic oil flowing in through the first port 192A of the oil distribution box 190 flows to the front end of the hydraulic locking unit 191 and may flow to the first hydraulic line 145A opened at the end of the hollow shaft 211. The hydraulic oil introduced through the second port 192B flows to the rear end of the hydraulic locking unit 191, and may pass between the hydraulic locking unit 191 and the propulsion shaft 1 to flow to the second hydraulic line 145B.

Therefore, when the hydraulic oil flows into the first port 192A, the hollow shaft 211 moves forward while the piston 141 moves forward. At this time, as the hollow shaft 211 passes through the hydraulic locking unit 191, the front end of the hollow shaft 211 moves to the front of the hydraulic locking unit 191.

Conversely, when the hydraulic oil flows through the second port 192B, the hollow shaft 211 moves backward while the piston 141 moves backward.

Here, a space formed on the inner bow side of the hydraulic locking unit 191 so that the front end of the hollow shaft 211 may be moved is referred to as a first chamber 193A. Also, a space between the rear end of the hydraulic locking unit 191 and the propulsion shaft 1 is referred to as a second chamber 193B.

Meanwhile, two locking rings 194A, 194B are positioned with an interval D3 inside the hydraulic locking unit 191. The two locking rings 194A, 194B surround the hollow shaft 211. In addition, two grooves 195A, 195B matched with the locking rings 194A, 194B are formed with an interval D4 on the hollow shaft 211. The distance D4 between the grooves 195A, 195B corresponds to the sum of the distance D3 between the locking rings 194A, 194B and the distance between the top dead center and the bottom dead center. Although not shown in the drawings, the locking rings 194A, 194B have a structure in which a portion thereof is open, and their diameters may be expanded or contracted by elasticity.

Therefore, in the movement of the hollow shaft 211 together with the movement of the piston 141, when the pin 125 is located at the top dead center 133H (when the stroke of the hydraulic system 140 is contracted to the maximum), a first groove 195A formed on the front end side of the hollow shaft 211 is matched with the first locking ring 194A. When the pin 125 is located at the bottom dead center (when the stroke of the hydraulic system is extended to the maximum), the second groove 195B formed inside the length of the hollow shaft 211 is matched with the second locking ring 194B. As such, when any one of the locking rings 194A, 1948 is matched with any one of grooves 195A, 195B, the hollow shaft 211 moving together with the piston 141 stops moving. Accordingly, the propeller pitch is locked so as not to be varied by resistance or external impact.

Hereinafter, a structure of the hydraulic locking unit 191 will be described in detail.

The hydraulic locking unit 191 is fixed to the inside of the propulsion shaft 1, and a first flow path 196A communicating with the first chamber 193A is formed at the front end of the hydraulic locking unit 191. A second flow path 196B communicating with the second chamber 1936 is formed at the rear end of the hydraulic locking unit 191.

Also, the first locking ring 194A is positioned to correspond to the front end side of the hollow shaft 211, that is, the first flow path 196A, while surrounding the hollow shaft 211. The second locking ring 1946 is positioned to correspond to the second flow path 196B.

In addition, a slide locker 213 moving along the hollow shaft 211 is mounted on the hydraulic locking unit 191. The two slide lockers 213 move respectively in the longitudinal direction of the hollow shaft 211 by the interaction of the hydraulic pressure of hydraulic oil flowing into the hydraulic locking unit 191 through the first flow path 196A or the second flow path 196B and the elastic force of the support spring 215 supporting the slide locker 213.

The slide locker 213 has a holder structure, and while moving in the longitudinal direction of the hollow shaft 211, it surrounds the locking rings 194A, 194B matched with the grooves 195A, 195B, thereby locking the locking rings 194A, 194B so that they do not deviate from the grooves 195A, 195B. Alternatively, the slide locker 213 is positioned so that the locking rings 194A, 194B may come out of the grooves 195A, 195B by detaching from the locking rings 194A, 194B. When both of the two locking rings 194A, 194B are separated from the grooves 195A, 195B, the hollow shaft 211 is in an unlocked state as being movable forward and backward.

Meanwhile, a spring holder 217 is fixed in the middle of the length of the hydraulic locking unit 191. End portions of the support springs 215 located on both sides of the spring holder 217 are inserted into and supported by the spring holder 217.

Hereinafter, the locking and unlocking relationship according to the operation of the hydraulic locking unit configured as described above will be described in detail with reference to FIGS. 20 to 22.

As shown in FIGS. 20 to 22, in a state where the stroke of the hydraulic system 140 is extended to the maximum (a state where the pin is located at top dead center), the hydraulic oil is filled in the rear of the cylinder 143, and the piston 141 is in the forward state, that is, the hollow shaft 211 is in the forward state. At this time, as the hollow shaft 211 is positioned by moving forward to the inside of the first chamber 193A, the second locking ring 194B is matched with the second groove 195B, and the slide locker 213 surrounds the second locking ring 1946 to prevent unlocking.

In this state, when hydraulic oil flows in through the second port 192B, the hydraulic oil moves toward the rear end of the hydraulic locking unit 191 and flows into the second chamber 193B, thereby generating hydraulic pressure so that the slide locker 213 moves forward through the second flow path 196B. In addition, when the slide locker 213 moves forward and unlocks the second locking ring 194B, the hollow shaft 211 is in a movable state, and the hollow shaft 211 moves backward while the hydraulic oil is filled in the front of the cylinder 143 through the second chamber 193B and the second hydraulic line 145B. At the same time, the hydraulic oil located in the rear of the cylinder 143 flows out through the first hydraulic line 145A, the first chamber 193A, the first flow path 196A, and the first port 192A.

In this way, as the hollow shaft 211 moves backward, the first groove 195A of the hollow shaft 211 moves toward the first locking ring 194A, and the first locking ring 194A is matched with the first groove 195A and locked, which is a state where the stroke of the hydraulic system 140 is contracted to the maximum with the pin 125 positioned at the bottom dead center 133L.

When the first locking ring 194A is matched with the first groove 195A in this way, the slide locker 213 moves forward by the elastic force of the support spring 215 to surround the matched first locking ring 194A, thereby preventing unlocking.

As described above, the hydraulic locking unit 191 maintains the locked state by matching the grooves 195A, 195B and the locking rings 194A, 194B when the pin 125 is located at the top dead center or the bottom dead center, thereby keeping the propeller pitch from being varied by the resistance or external impact occurring due to the rotation of the propeller. In addition, the hydraulic locking unit 191 is unlocked by the hydraulic pressure of the hydraulic oil flowing in and out to expand and contract the stroke of the hydraulic system 140, so that the pin 125 may move from the top dead center 133H to the bottom dead center 133L or from the bottom dead center 133L to the top dead center 133H.

Fourth Embodiment of Locking Device at Each Dead Center

The locking device according to the fourth embodiment to be described below locks the pin to prevent the blade pitch from being varied due to external resistance, impact, or the like when the pin is positioned at the top dead center and the bottom dead center. The configuration of the locking device (in FIGS. 11 to 14) of the first embodiment described above is included. Therefore, redundant description of the configuration described in the first embodiment will be omitted.

Figure 23:
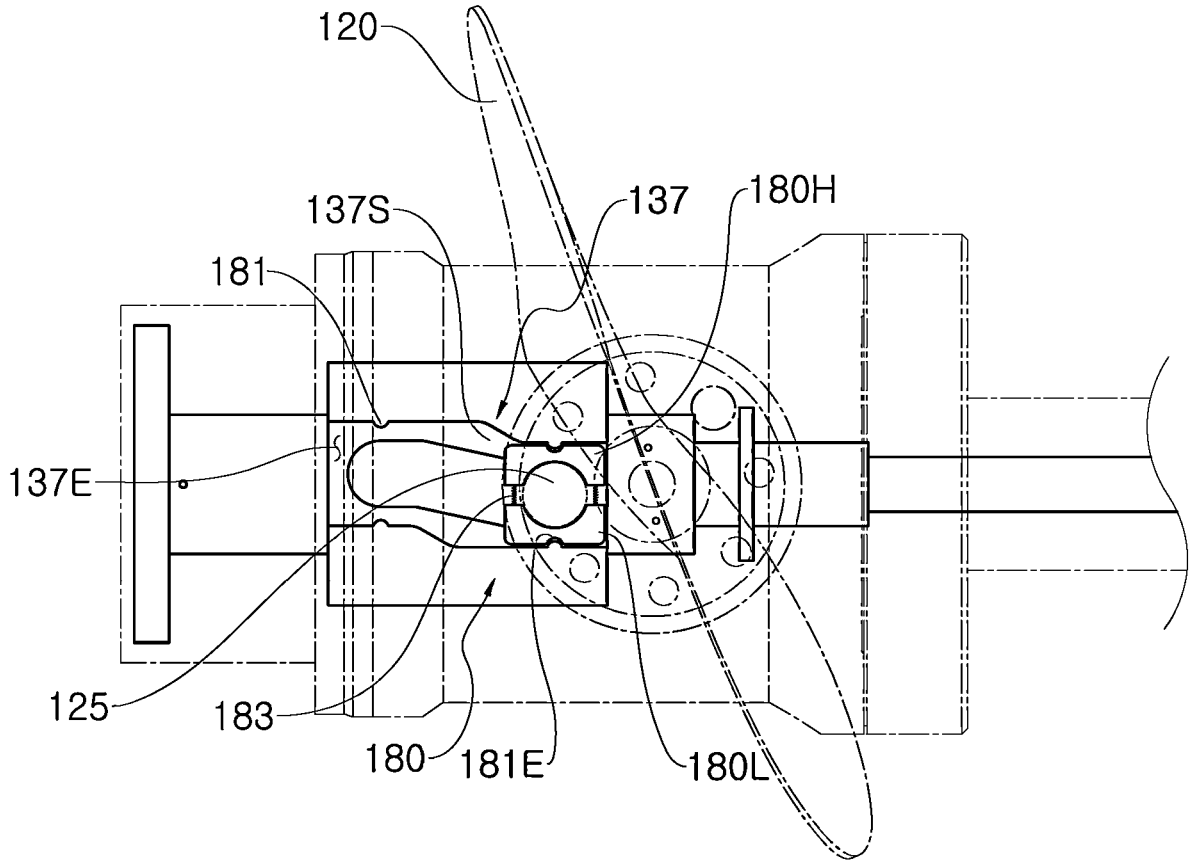
FIG. 23 is a conceptual view illustrating a controllable pitch propeller having a locking shoe according to an embodiment of the present disclosure.
Figure 24A:
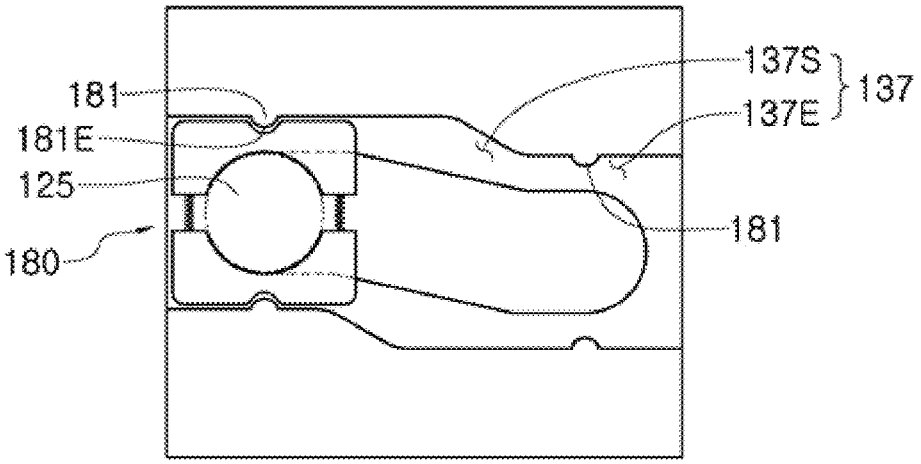
FIG. 24A to 24C are conceptual views illustrating the locking and unlocking relationship of the locking shoe in accordance with the movement path of the pin according to the forward and backward movement of the crosshead.
Figure 24B:
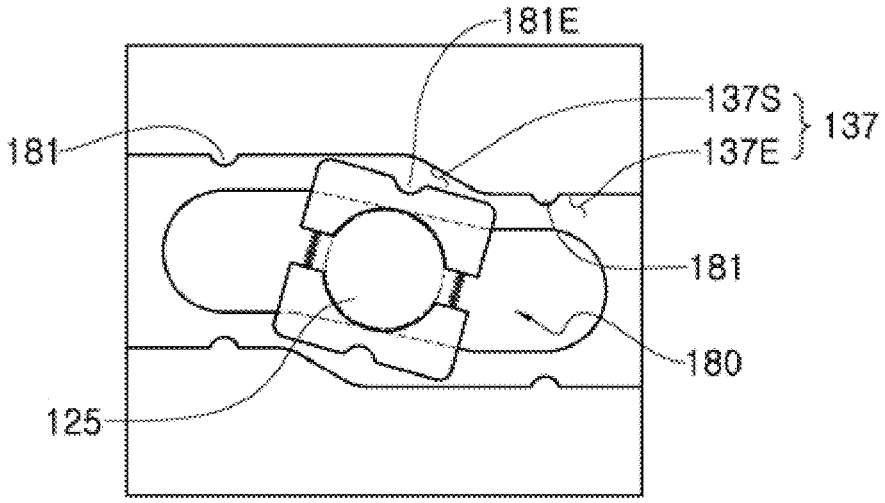
Figure 24C:
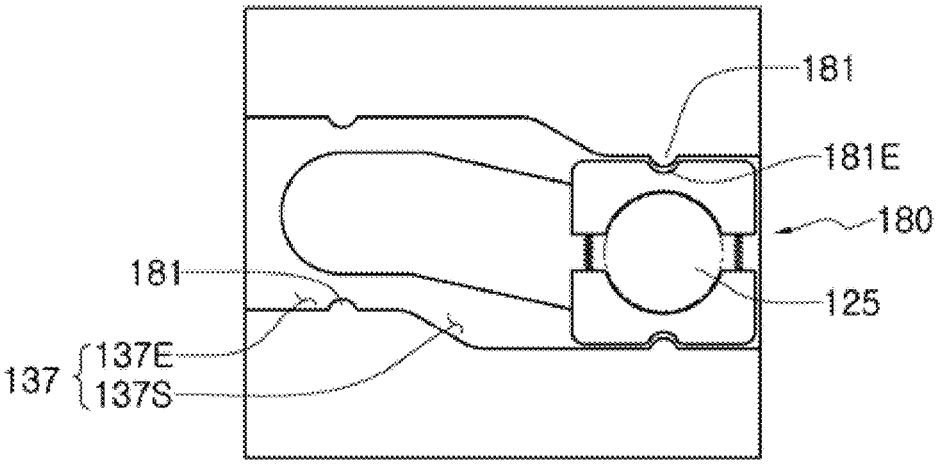
Figure 25:
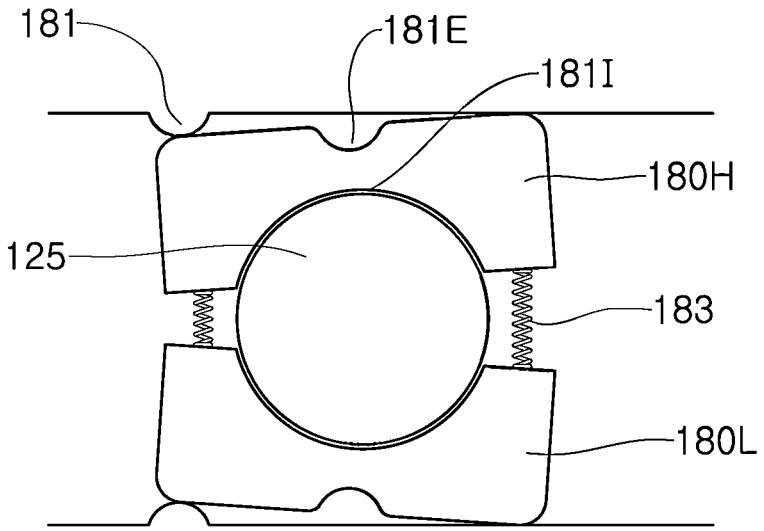
FIG. 25 is a detailed view illustrating the deformation relationship of the locking shoe according to the coupling of the locking block and the locking shoe.

In the drawings, FIG. 23 is a conceptual view illustrating a controllable pitch propeller having a locking shoe according to an embodiment of the present disclosure. FIG. 24A to 24C are conceptual views illustrating the locking and unlocking relationship of the locking shoe in accordance with the movement path of the pin according to the forward and backward movement of the crosshead. FIG. 25 is a detailed view illustrating the deformation relationship of the locking shoe according to the coupling of the locking block and the locking shoe.

As shown in FIG. 23, a guide slot 133, an end slot 135, and a second guide slot 137 are formed in the crosshead 131. A pin 125 is inserted into the guide slot 133, and according to the forward and backward movement of the crosshead 131, the pin 125 moves between the top dead center 133H and the bottom dead center 133L of the guide slot 133. At each dead center, the pin 125 is inserted into or withdrawn from the end slot 135.

Meanwhile, the guide slot 133 and the end slot 135 are formed at the bottom of the second guide slot 137 in the same way as the configuration of the second guide slot 137 of the first embodiment. The diagonal portion 137S of the second guide slot 137 corresponds to the guide slot 133, and the end portion 137E of the second guide slot 137 corresponds to the end slot 135.

In addition, the locking device according to the fourth embodiment includes a protrusion 181 formed at the end portion 137E of the second guide slot 137 and a locking shoe 180 surrounding the pin 125. The locking shoe 180 of the locking device moves along the diagonal portion 137S and the end portion 137E of the second guide slot 137.

In the locking device of the fourth embodiment, the locking shoe 180 is configured to replace the sliding shoe (150 in FIG. 13) described in the first embodiment. In the first embodiment, the sliding shoe 150 is positioned at the end portion 137E of the second guide slot 137 and is in surface contact to prevent the pin 125 from moving due to resistance and impact. In the fourth embodiment, by matching the locking shoe 180 and the protrusion 181 in addition to the surface contact function, it is possible to more effectively prevent the pin 125 from moving due to resistance and impact.

Hereinafter, the structure and organic coupling relationship of the protrusion 181 and the locking shoe 180 formed at the end portion 137E of the second guide slot 137 will be described.

As shown in FIGS. 23 to 25, end portions 137E are formed along the center line of the propulsion shaft 1 at both ends of the second guide slot 137, and protrusions 181 are respectively formed on the inner surface facing the end portion 137E. The end of the protrusion 181 is configured to pass over the locking shoe 180 in a hemispherical shape.

Meanwhile, as the crosshead 131 moves forward or backward by the hydraulic pressure of the hydraulic system 140, the locking shoe 180 surrounding the pin 125 moves relatively together with the pin 125 along the end portion 137E and the diagonal portion 137S of the second guide slot 137.

The locking shoe 180 has the same structure as the sliding shoe 150 described in the first embodiment, and includes an upper locking shoe 180 and a lower locking shoe 180, wherein a pin 125 is inserted between the upper locking shoe 180 and the lower locking shoe 180. In this way, a groove 1811 in contact with the outer circumferential surface of the pin 125 is formed on the surface facing the upper locking shoe 180 and the lower locking shoe 180 so that the pin 125 may be inserted between the upper locking shoe 180 and the lower locking shoe 180. Coil springs 183 supporting the upper locking shoe 180 and the lower locking shoe 180 are positioned at both sides of the groove 1811.

In addition, matching grooves 181E matching the protrusions 181 are formed on the outer surface of the upper locking shoe 180 and the outer surface of the lower locking shoe 180 facing the inner surface of the second guide slot 137.

The locking shoe 180 configured as described above moves along the second guide slot 137 together with the movement of the pin 125. At this time, the outer surface of the upper locking shoe 180 and the outer surface of the lower locking shoe 180 are positioned facing the inner surface of the second guide slot 137 in the diagonal portion 137S and the end portion 137E of the second guide slot 137. When the locking shoe 180 passes the end portion 137E, the diagonal portion 137S, and the protrusion 181, the coil spring 183 expands and contracts as the width becomes narrower or wider, thereby changing the slope of the upper locking shoe 180 and the lower locking shoe 180.

That is, when the width of the locking shoe 180 is narrowed by the structure of the second guide slot 137 and the protrusion 181 in the movement of the locking shoe 180 along the second guide slot 137, the coil spring 183 located on the narrowing side among the coil springs 183 located at the front or rear of the pin 125 is contracted, and the locking shoe 180 moves from the end portion 137E to the diagonal portion 137S, or from the diagonal portion 137S to the end portion 137E while compensating for the narrowing of the width.

Also, in the structure where the locking shoe 180 moves in response to a change in the width of the second guide slot 137, as the width between the protrusions 181 is narrower than the width of the second guide slot 137 in the same manner even when located at the end portion 137E in which the protrusion 181 is formed, the coil spring 183 is contracted to pass the protrusion 181, and the protrusion 181 and the matching groove 181E are matched with each other to be locked.

In this state, when the crosshead 131 is moved by the operation of the hydraulic system, the pin 125 moves along the guide slot 133, and the locking shoe 180 also moves along the second guide slot 137 following the pin 125. As the locking shoe 180 matched with the protrusion 181 moves, the protrusion 181 is separated from the matching groove 181E and unlocked.

In this way, the locking device according to the fourth embodiment may increase the reliability of locking through the matching relationship between the protrusion 181 and the matching groove 181E together with the surface contact compared to the locking device of the first embodiment.

First Embodiment of Hydraulic System

Generally, in order to control the stroke of a hydraulic system, hydraulic ports are mounted at the front and rear ends of the cylinder, and hydraulic oil flows in or out of the front or rear of the cylinder through the hydraulic port, so that the piston moves and the stroke is controlled.

The controllable pitch propeller described above is configured to move the piston while a plurality of hydraulic lines formed inside the rod are introduced or discharged to the front or rear of the cylinder with respect to the piston in order to move the piston in the front-rear direction. On the other hand, the hydraulic system to be described below is configured such that a coil spring for pressing the piston forward or backward is built in the cylinder, thereby replacing hydraulic pressure with elastic force.

Figure 26:
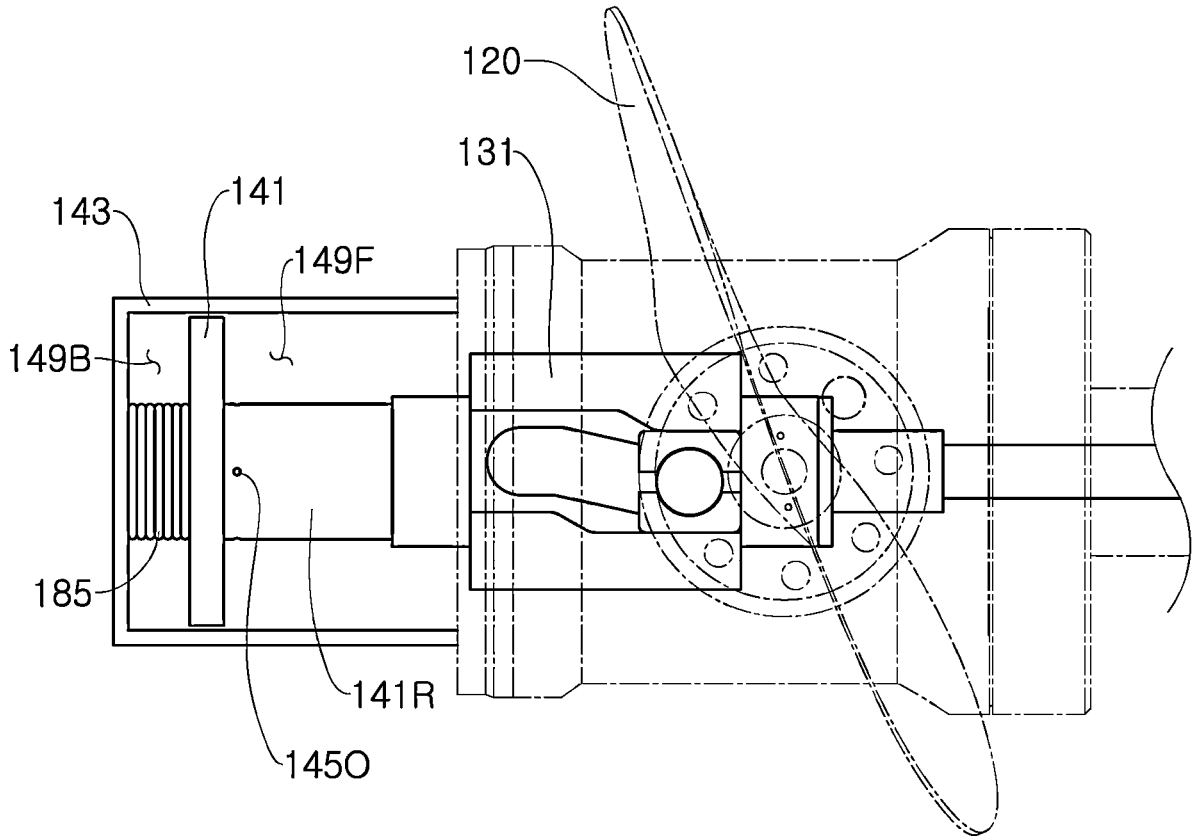
FIG. 26 is a cross-sectional view illustrating a state in which the piston moves backward in accordance with the operation of the hydraulic system of the controllable pitch propeller according to an embodiment of the present disclosure.
Figure 27:
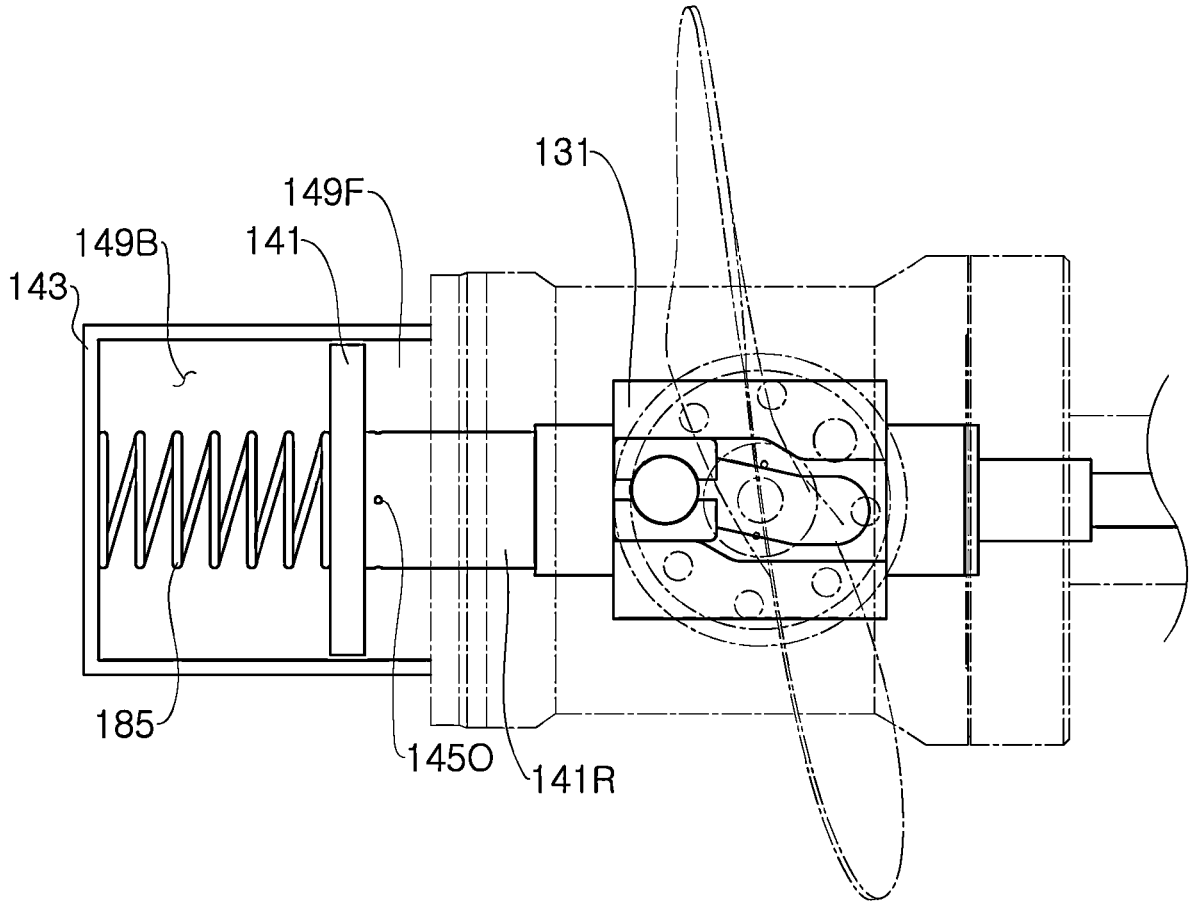
FIG. 27 is a cross-sectional view illustrating a state in which the piston moves forward by the elastic force of the coil spring while the hydraulic pressure is released.
Figure 28A:
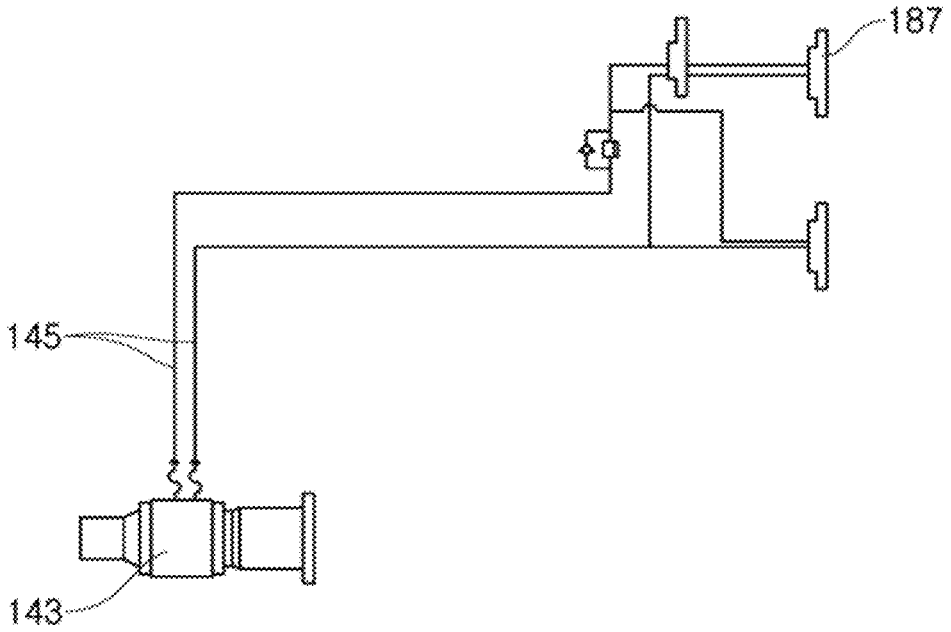
FIGS. 28A and 28B are conceptual views comparing a hydraulic circuit having a server hydraulic cylinder according to an embodiment of the present disclosure with a conventional hydraulic circuit.
Figure 28B:
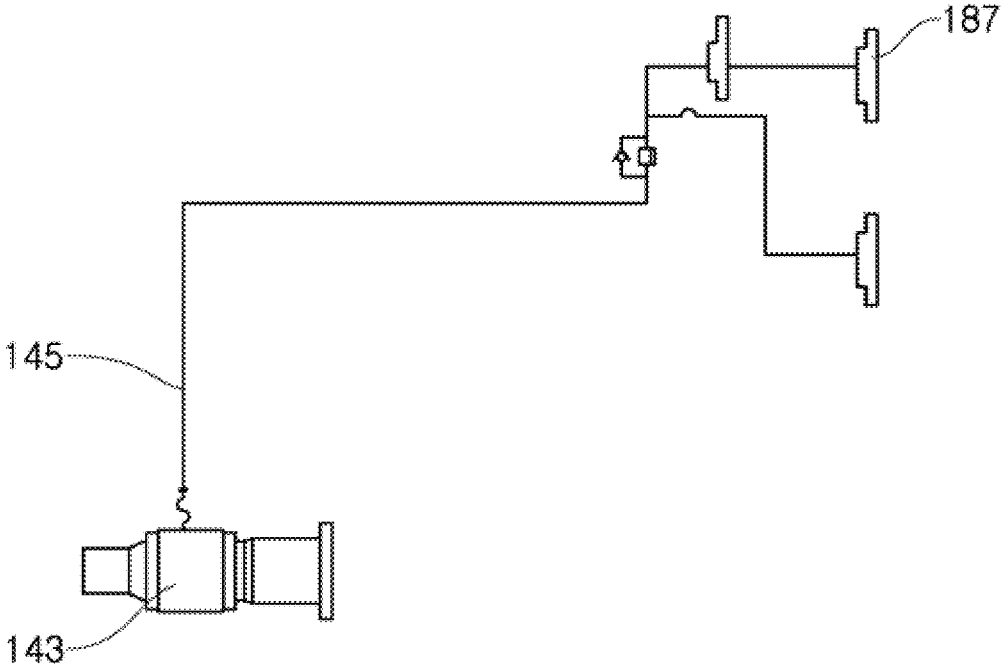
Figure 29A:
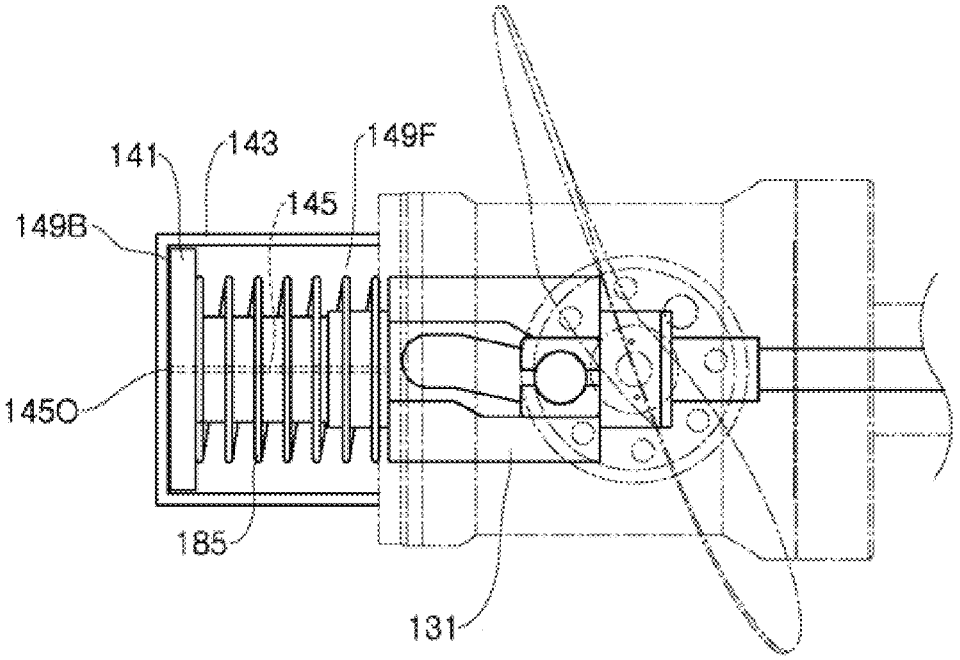
FIGS. 29A and 29B are conceptual views illustrating a modified example of the hydraulic system shown in FIG. 26.
Figure 29B:
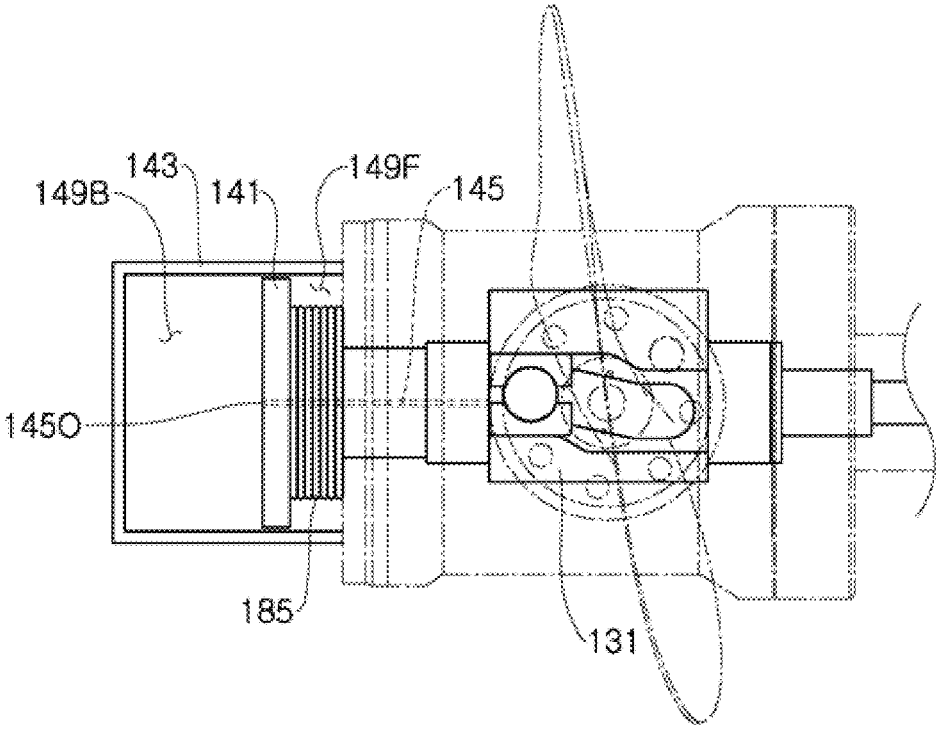

In the drawings, FIG. 26 is a cross-sectional view illustrating a state in which the piston moves backward in accordance with the operation of the hydraulic system of the controllable pitch propeller according to an embodiment of the present disclosure. FIG. 27 is a cross-sectional view illustrating a state in which the piston moves forward by the elastic force of the coil spring while the hydraulic pressure is released. FIGS. 28A and 28B are conceptual views comparing a hydraulic circuit having a server hydraulic cylinder according to an embodiment of the present disclosure with a conventional hydraulic circuit. FIGS. 29A and 29B are conceptual view illustrating a modified example of the hydraulic system shown in FIG. 26.

As shown in FIG. 26, the piston 141 is located inside the cylinder 143 of the hydraulic system 140 connected to the rear end of the hub 130, and the rod 141R extended from the piston 141 is connected to the crosshead 131 by extending to the outside of the cylinder 143.

When dividing the inside of the cylinder 143 based on the piston 141, the space formed in front of the piston 141 is referred to as a 'front chamber 149F' below, and the space formed in the rear of the piston 141 is referred to as a 'rear chamber 1496'. Here, a compression coil spring 185 is located in the rear chamber 1496, and the coil spring 185 presses the piston 141 so that the piston 141 moves in the direction in which the stroke of the hydraulic system 140 extends, that is, toward the bow.

In addition, the orifice 1450 of the hydraulic line 145 formed inside the rod 141R is formed in front of the piston 141. Therefore, the hydraulic oil supplied through the hydraulic line 145 is filled in the front chamber 149F to generate hydraulic pressure so that the piston 141 moves backward. In this way, when the piston 141 moves backward by hydraulic pressure, the coil spring 185 located in the rear chamber 1496 is pushed by the piston 141 and contracted.

Meanwhile, when the supply of hydraulic oil supplied through the hydraulic line 145 is blocked, the hydraulic line 145 is opened by the control valve 187 shown in FIGS. 28A and 28B, which controls the supply of hydraulic oil, and the hydraulic pressure applied to the piston 141 is released, so that the piston 141 moves forward by the elastic force of the compressed coil spring 185. As the piston 141 moves forward in this way, the hydraulic oil filled in the front chamber 149F is discharged through the hydraulic line 145.

As described above, by supplying the hydraulic oil to the rear chamber 1496 through the hydraulic line 145 extended to the rear chamber 1496, the stroke of the hydraulic system 140 is contracted, and accordingly, the crosshead 131 moves backward to rotate the blade 120 counterclockwise. In addition, when the hydraulic line 145 is opened through the control valve 187, the stroke of the hydraulic system 140 is extended by the elastic force of the coil spring 185, and accordingly, the crosshead 131 moves forward to rotate the blade 120 clockwise. In this way, the blade pitch may be varied by the hydraulic pressure of the hydraulic system 140 and the elastic force of the coil spring 185.

Meanwhile, FIGS. 29A and 29B are modifications of the structure of the hydraulic system shown in FIGS. 26 to 28, and is configured such that the coil spring 185 is located in the front chamber 149F and the hydraulic line 145 passes through the piston 141 to be supplied to the rear chamber 149B.

In this case, when the hydraulic oil is supplied to the rear chamber 149B, the stroke of the hydraulic system 140 is extended, and the blade 120 rotates clockwise while the crosshead 131 moves forward. Also, when the hydraulic line 145 is opened through the control valve 187, the stroke of the hydraulic system 140 is contracted by the elastic force of the coil spring 185, and accordingly, the blade 120 rotates counterclockwise while the crosshead 131 moves backward.

Meanwhile, FIG. 28A shows a hydraulic circuit for expanding and contracting the stroke of the hydraulic system by hydraulic oil, and FIG. 28B shows a hydraulic circuit for expanding and contracting the stroke of the hydraulic system by hydraulic oil and a coil spring.

As shown in FIG. 28A, the hydraulic line 145 should be connected to the front chamber 149F and the rear chamber 149B, respectively, in order to expand and contract the stroke of the hydraulic system 140 by hydraulic oil, and thus, the configuration of the hydraulic system was complicated. On the other hand, in the configuration in which the stroke of the hydraulic system 140 is expanded and contracted by the hydraulic oil and the coil spring 185 as shown in FIG. 28B, the hydraulic line 145 is connected to any one of the front chamber 149F and the rear chamber 149B, and thus, there is an advantage in that the configuration of the hydraulic system 140 is simple.

As the configuration of the hydraulic system 140 mounted inside the hub 130 is simplified in this way, the size of the hub 130 may be reduced to express high efficiency close to the propulsion efficiency of the fixed pitch propeller.

Second Embodiment of Hydraulic System

As described above, the controllable pitch propeller according to the present disclosure is variable in two pitches.

In the case of a conventional controllable pitch propeller, the pitch variable range is wide and a hydraulic system capable of proportional control should be provided as the pitch is controlled in five stages in general. On the other hand, when the blade pitch is varied only by two pitches as in the present disclosure, it is possible to control the hydraulic system through the on-off valve.

Figure 30:
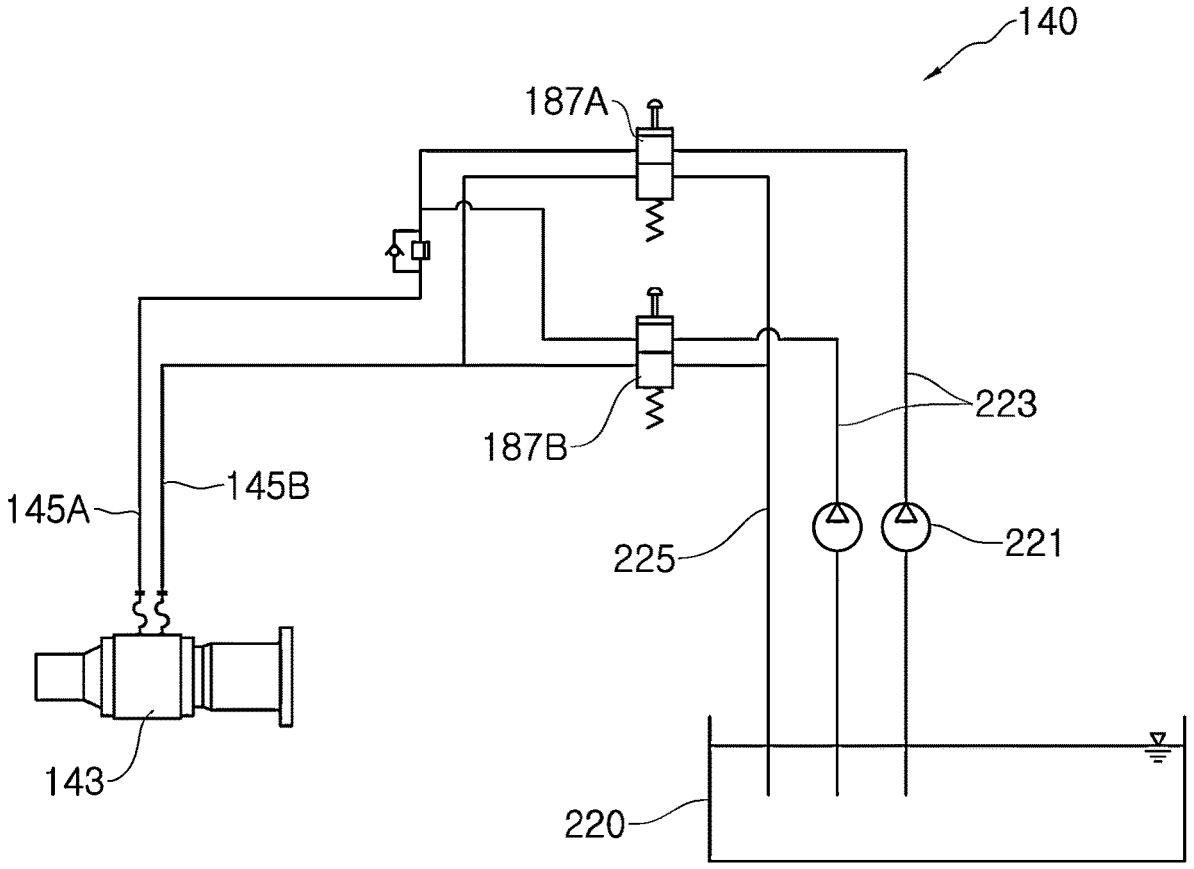
FIG. 30 is a conceptual view illustrating a hydraulic system having an on-off valve according to an embodiment of the present disclosure.
Figure 31:
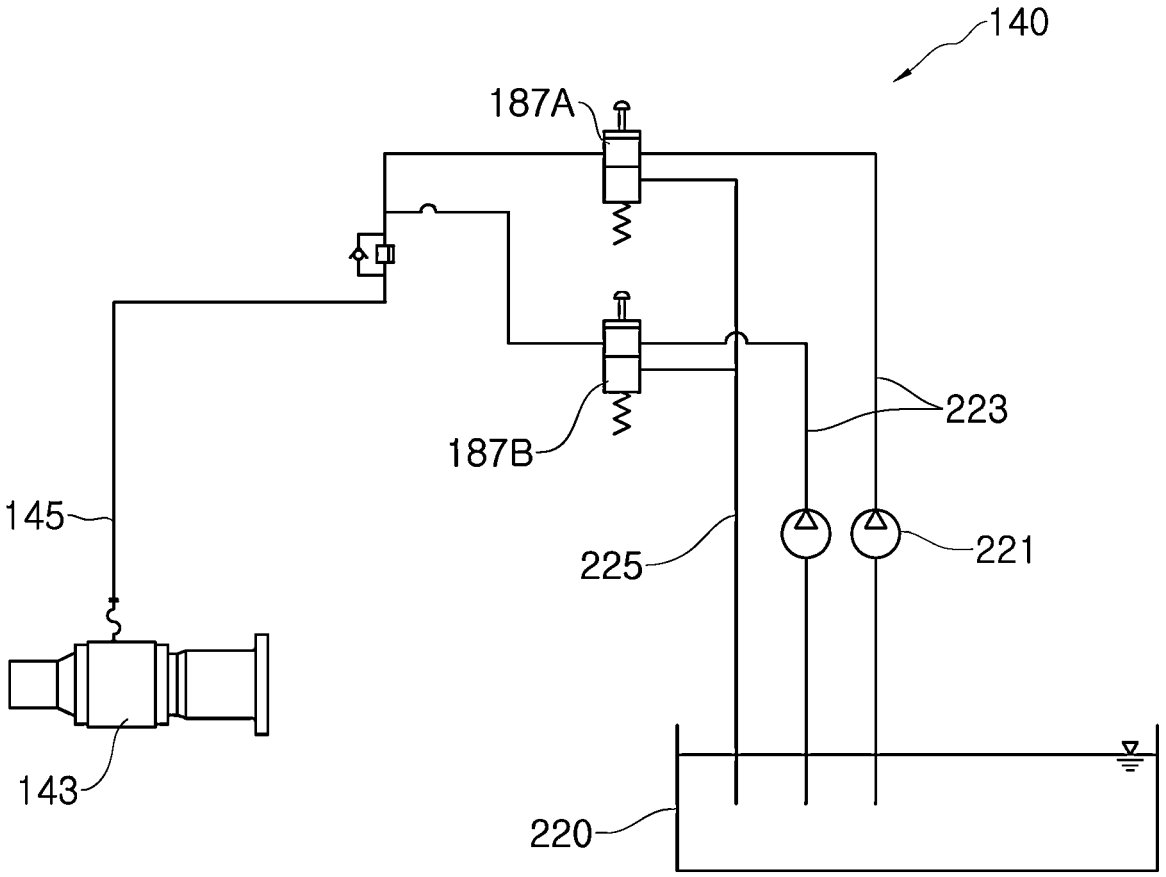
FIG. 31 is a conceptual view illustrating a hydraulic system having an on-off valve in a state in which a coil spring is mounted inside a cylinder as shown in FIG. 26.

In the drawings, FIG. 30 is a conceptual view illustrating a hydraulic system having an on-off valve according to an embodiment of the present disclosure. FIG. 31 is a conceptual view illustrating a hydraulic system having an on-off valve in a state in which a coil spring is mounted inside a cylinder as shown in FIG. 26.

As shown in FIG. 30, two hydraulic lines 145A, 145B are connected to the cylinder 143 of the hydraulic system 140 mounted at the rear end of the hub 130, wherein the first hydraulic line 145A is branched and connected to the first on-off valve 187A and the second on-off valve 187B, and the second hydraulic line 145B is also branched and connected to the first on-off valve 187A and the second on-off valve 187B. Here, the second on-off valve 187B corresponds to an emergency control valve.

In addition, the hydraulic oil supply line 223 extended from the oil pump 221 and the drain line 225 extended from the oil tank 220 are connected to the first on-off valve 187A and the second on-off valve 1876, respectively.

Therefore, the hydraulic oil supplied by the operation of the oil pump 221 is normally supplied to the cylinder 143 through the first on-off valve 187A, which is an operation control valve. The hydraulic oil flowing out of the cylinder 143 is discharged to the oil tank 220 through the first on-off valve 187A.

As the hydraulic oil flows into or out of the cylinder 143 by the operation of the first on-off valve 187A or the second on-off valve 1876 in this way, a two-step control in which the stroke of the hydraulic system 140 is extended or contracted is performed.

When the stroke of the hydraulic system 140 is extended, the pin 125 is located at the top dead center 133H of the guide slot 133, and when the stroke is contracted, the pin 125 is located at the bottom dead center 133L of the guide slot 133, thereby controlling the blade pitch to 2 pitches.

Meanwhile, the circuit diagram of the hydraulic system shown in FIG. 31 is configured such that the piston 141 moves by the elastic force of the coil spring 185 when the hydraulic line 145 is opened by mounting the coil spring 185 (in FIGS. 26 and 27) inside the cylinder 143 as shown in FIG. 26. Also in this case, in one hydraulic line 145 extended to the cylinder 143, the first on-off valve 187A, the second on-off valve 1876, the oil pump 221, the oil tank 220, the hydraulic oil supply line 223, and the drain line 225, as described above, are installed in the same manner.

In this case, when hydraulic oil is supplied through the hydraulic line 145, the piston 141 moves in a direction in which the coil spring 185 is compressed by the hydraulic oil flowing into the cylinder 143. Accordingly, the stroke of the hydraulic system 140 is extended or contracted, and when the hydraulic line 145 is opened, the compressed coil spring 185 is extended. Accordingly, the piston 141 moves in a direction in which the elastic force of the coil spring 185 is provided, and the hydraulic oil inside the cylinder flows toward the oil tank 220 through the opened hydraulic line 145.

The hydraulic system 140 of the controllable pitch propeller 100 shown in FIG. 31 is also located at the top dead center 133H of the guide slot 133 when the stroke is extended, and the pin 125 is located at the bottom dead center 133L of the guide slot 133 when the stroke is contracted, thereby controlling the blade pitch to 2 pitches.

Meanwhile, as an on-off valve, it may be configured as a solenoid valve, or alternatively, a valve capable of two-step control in which the hydraulic line is opened or closed by the valve may be adopted.

DESCRIPTION OF REFERENCE SIGNS

1: propulsion shaft
100: controllable pitch propeller
120: blade
121: blade shank
123: blade carrier
124: pin
130: hub
131: crosshead
133: guide slot
133H: top dead center

133L: bottom dead center
135: end slot
137: second guide slot
137S: diagonal portion
137E: end portion
139: locking hole
140: hydraulic system
141: piston
141R: rod
143: cylinder
145: hydraulic line
145A: first hydraulic line
145B: second hydraulic line
147F: front stopper
147B: rear stopper
150: sliding shoe
150M: upper sliding shoe
150L: lower sliding shoe
153: coil spring
160: slider
161: opening
163: long groove
165: rail
165S: inclined portion
170: plug
170S: inclined surface
171: coil spring
180: locking shoe
180H: upper locking shoe
180L: lower locking shoe
181: protrusion
183, 185: coil spring
187: control valve
187A, 187B: on-off valve
190: oil distribution box
191: hydraulic locking unit
192A, 192B: port
193A, 193B: chamber
194A, 194B: locking ring
195A, 195B: groove
196A, 196B: flow path
210: slide shaft
211: hollow shaft
213: slide locker
215: support spring
217: spring holder
220: oil tank
221: oil pump
223: supply line
225: drain line

The invention claimed is:

1. A controllable pitch propeller comprising:
a hub mounted on a propulsion shaft of a ship;
a crosshead at least partially received in the hub; and
a blade mounted around the hub and coupled to the crosshead, the blade having a variable pitch,
wherein the crosshead has a shape of a cross such that the H/D ratio of the hub diameter H to the propeller diameter D is 0.170 to 0.2.

2. The controllable pitch propeller according to claim 1, wherein in the case of a Tanker that is a low-speed ship, the H/D ratio is 0.170 to 0.190.

3. The controllable pitch propeller according to claim 1, wherein in the case of a Bulk Carrier that is a low-speed ship, the H/D ratio is 0.185 to 0.20.

4. The controllable pitch propeller according to claim 1, wherein the crosshead has a diagonal guide slot, and the blade engages the diagonal guide slot.

5. The controllable pitch propeller according to claim 4, wherein the crosshead has a locking device for locking a position of the blade with respect to the diagonal guide slot.

6. The controllable pitch propeller according to claim 1, wherein the hub is movable in a longitudinal direction by hydraulic pressure.

7. A controllable pitch propeller for a ship, comprising:
a hub mounted on a propulsion shaft of the ship, the hub being movable in a longitudinal direction by hydraulic pressure;
a crosshead at least partially received in the hub; and
at least one blade mounted to the hub, the at least one blade having a variable pitch, and the at least one blade being slidably coupled to the crosshead,
wherein the H/D ratio of the hub diameter H to the propeller diameter D is less than or equal to 0.20.

8. The controllable pitch propeller according to claim 7, wherein the H/D ratio is 0.170 to 0.20.

9. The controllable pitch propeller according to claim 7, wherein the H/D ratio is 0.170 to 0.190.

10. The controllable pitch propeller according to claim 7, wherein the H/D ratio is 0.185 to 0.20.

11. The controllable pitch propeller according to claim 7, wherein the crosshead is movable in the longitudinal direction of the hub.

12. The controllable pitch propeller according to claim 7, wherein the at least one blade includes a blade carrier which has a pin received in a guide slot of the crosshead.

13. The controllable pitch propeller according to claim 12, wherein the guide slot of the crosshead is diagonal with respect to the longitudinal direction, and the pin is movable along the guide slot.

14. The controllable pitch propeller according to claim 13, wherein the at least one blade is rotated by the pin moving between opposite end of the guide slot.

15. The controllable pitch propeller according to claim 14, wherein each end of the guide slot has a locking end slot for locking in the pin.

16. The controllable pitch propeller according to claim 7, wherein the one blade is slidably coupled to the crosshead in a direction of movement that is a diagonal line with respect to a center line of the propulsion shaft.

17. The controllable pitch propeller according to claim 7, wherein the crosshead has a shape of a cross.

18. The controllable pitch propeller according to claim 7, wherein a hydraulic system is coupled to the crosshead.

* * * * *